US011415908B2

(12) United States Patent
Matsumoto

(10) Patent No.: US 11,415,908 B2
(45) Date of Patent: Aug. 16, 2022

(54) MULTI-BEAM LIGHT SOURCE DRIVING DEVICE AND IMAGE FORMING APPARATUS INCLUDING SAME, AND MULTI-BEAM LIGHT SOURCE DRIVING METHOD

(71) Applicant: SHARP KABUSHIKI KAISHA, Sakai (JP)

(72) Inventor: Kazutaka Matsumoto, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/220,261

(22) Filed: Apr. 1, 2021

(65) Prior Publication Data

US 2021/0325796 A1 Oct. 21, 2021

(30) Foreign Application Priority Data

Apr. 21, 2020 (JP) ..... JP2020-075180

(51) Int. Cl.
*G03G 15/043* (2006.01)
*G03G 15/04* (2006.01)

(52) U.S. Cl.
CPC ..... *G03G 15/043* (2013.01); *G03G 15/04072* (2013.01)

(58) Field of Classification Search
CPC ..... G03G 15/04072; G03G 15/043
See application file for complete search history.

(56) References Cited

U.S. PATENT DOCUMENTS

2009/0003862 A1* 1/2009 Tominaga ..... G03G 15/326 399/51
2011/0228030 A1* 9/2011 Maeda ..... G03G 15/326 347/118
2011/0228037 A1* 9/2011 Omori ..... G03G 15/04072 347/247
2013/0235141 A1* 9/2013 Onishi ..... G03G 15/04 347/118

FOREIGN PATENT DOCUMENTS

JP 2013-043432 A 3/2013

* cited by examiner

*Primary Examiner* — Carla J Therrien
(74) *Attorney, Agent, or Firm* — ScienBiziP, P.C.

(57) ABSTRACT

A light source according to the present invention is for an exposure device of a multifunction peripheral and includes a multi-beam light source. Two laser diodes included in the multi-beam light source are individually driven by a laser driver. Reference signals Vref1 and Vref2 used to control the light emitting power of the laser diodes are individually generated by two reference signal generation circuits. The reference signals Vref1 and Vref2 are each generated by processing including digital calculation, and at least one of the reference signals Vref1 and Vref2 includes a component for correcting the relative output difference of the laser diodes.

11 Claims, 11 Drawing Sheets

MULTI-BEAM LIGHT SOURCE DRIVING DEVICE AND IMAGE FORMING APPARATUS INCLUDING SAME, AND MULTI-BEAM LIGHT SOURCE DRIVING METHOD

BACKGROUND OF THE INVENTION

Field of the Invention

The present invention relates to a multi-beam light source driving device for driving a multi-beam light source including a plurality of light emitting elements, an image forming apparatus including the multi-beam light source driving device, and a multi-beam light source driving method.

Description of the Background Art

In an electrophotographic image forming apparatus, in a process of image forming processing for forming an image based on an image signal on a sheet-like image recording medium such as paper, exposure processing for forming a latent image based on the image signal on the surface of a photoconductor is performed. Specifically, a light source including a light emitting element that emits a light beam, for example, a laser diode that emits a laser beam as a light beam is driven on the basis of an image signal. The laser beam emitted from this light source irradiates the surface (outer peripheral surface) of a photoconductor drum, which is a substantially cylindrical photoconductor. In addition, the photoconductor drum rotates about its center. Additionally, the irradiation position of the laser beam with respect to the surface of the photoconductor drum is moved in a direction along the rotation axis of the photoconductor drum. As a result, a latent image, which is an image of static electricity, is formed on the surface of the photoconductor drum. In doing so, the irradiation intensity of the laser beam with respect to the surface of the photoconductor drum becomes non-uniform in the direction along the rotation axis of the photoconductor drum, in a so-called main scanning direction. The non-uniformity of the laser beam irradiation intensity in the main scanning direction is called shading, and due to the characteristics of a deflector responsible for moving the irradiation position of the laser beam in the main scanning direction, particularly optical system elements including various mirrors such as polygon mirrors and various lenses such as fθ lenses. An example of a technique for correcting this shading is disclosed in Japanese Unexamined Patent Application Publication No. 2013-43432.

According to the technique disclosed in Japanese Unexamined Patent Application Publication No. 2013-43432, a correction value for correcting shading is obtained in advance by an experiment and stored in a memory. The correction values stored in this memory are sequentially read from the memory in accordance with the irradiation position of the laser beam in the main scanning direction. Then, the correction value read from the memory is converted from a digital signal to an analog signal by a DA converter and then input to a laser controller. In addition, an image signal is input to the laser controller. The laser controller drives a light source on the basis of the image signal and controls the light emitting power of the light source on the basis of the signal level of the analog signal converted by the DA converter. As a result, shading is corrected while forming a latent image based on the image signal.

Here, the ripple caused by the operation of the DA converter is superimposed on the analog signal converted by the DA converter, that is, the analog signal used for controlling the light emitting power of the light source by the laser controller. There is concern about the influence of this ripple, particularly on the latent image, and eventually on the finally formed image.

In order to reduce the influence of this ripple, the DA converter in the technique disclosed in Japanese Unexamined Patent Application Publication No. 2013-43432 includes a PDM (Pulse Density Modulation) signal outputter and a low-pass filter. The PDM signal outputter outputs a pulse density modulation signal according to the aforementioned correction value, and more specifically, outputs a pulse density modulation signal consisting of a pulse train including a number of pulses according to the correction value, per unit cycle shorter than the cycle corresponding to the maximum spatial frequency visible to humans (visual recognition cycle). Then, the low-pass filter applies low-pass filter processing to the pulse density modulation signal to thereby output an analog signal in which the high-frequency component of the pulse density modulation signal is cut. Such an analog signal, that is, an analog signal generated by applying low-pass filter processing to a pulse density modulation signal, is used for the control of the light emitting power of the light source by the laser controller, and thus the influence of the ripple superimposed on the analog signal is reduced.

Although not specified in Japanese Unexamined Patent Application Publication No. 2013-43432, the light source in the technique disclosed in the same document is a so-called single beam light source having only one light emitting element. On the other hand, there is also a multi-beam light source having a plurality of light emitting elements. This multi-beam light source is beneficial for speeding up and improving the quality of exposure processing, that is, for speeding up and improving the quality of the image forming processing including the exposure processing. Meanwhile, in a case where a multi-beam light source is adopted, it is necessary to correct the variation in the light emitting power between the plurality of light emitting elements due to the individual difference of each of the plurality of light emitting elements, a so-called relative output difference. It would be even more beneficial if this relative output difference could be corrected with a simple configuration.

Therefore, an object of the present invention is to provide a new technique that can correct the relative output difference of a plurality of light emitting elements with a simple configuration in a multi-beam light source driving device for driving a multi-beam light source, an image forming apparatus including the multi-beam light source driving device, and a multi-beam light source driving method.

SUMMARY OF THE INVENTION

In order to achieve this object, the present invention includes a first aspect relating to a multi-beam light source driving device, a second aspect relating to an image forming apparatus including the multi-beam light source driving device, and a third aspect relating to a multi-beam light source driving method.

Among these, the first aspect relating to a multi-beam light source driving device is a device for driving a multi-beam light source including a plurality of light emitting elements, and includes a driver and a plurality of first generators. The driver receives inputs of a plurality of first control signals. The plurality of first control signals referred to here are a plurality of analog signals individually corresponding to the plurality of light emitting elements, and are individually generated by the plurality of first generators. Then, the driver controls the light emitting power of a corresponding light emitting element on the basis of the signal level of each of the plurality of first control signals. Here, some or all of the plurality of first generators are correction parallel units. This correction parallel unit generates a first control signal including a first correction component for correcting the variation in the light emitting power between the plurality of light emitting elements due to the individual difference of each of the plurality of light emitting elements, that is, a relative output difference. Specifically, the correction parallel unit includes a first multiplier a first pulse generator, and a first filter. The first multiplier digitally multiplies a predetermined value for setting the signal level of the first control signal to a predetermined level and a first correction value for exhibiting the first correction component together. Then, the first pulse generator generates a first pulse signal which is a pulse density modulation signal according to the multiplication result by the first multiplier. The first filter applies low-pass filter processing to the first pulse signal to thereby generate the first control signal including the first correction component.

One of the plurality of first generators is a specific generator. This specific generator corresponds to a specific element which is a specific light emitting element among the plurality of light emitting elements, and generates the first control signal of the aforementioned predetermined level. Then, each of the first generators other than the specific generator generates the first control signal including the first correction component as the correction parallel unit.

The specific generator includes a second pulse generator and a second filter. The second pulse generator generates a second pulse signal which is a pulse density modulation signal according to the aforementioned predetermined value. Then, the second filter applies low-pass filter processing to the second pulse signal to thereby generate the first control signal of the predetermined level.

The multi-beam driving device according to the first aspect is, for example, for an image forming apparatus, and particularly for an electrophotographic image forming apparatus. The electrophotographic image forming apparatus includes a photoconductor drum and a deflector. The photoconductor drum has a substantially cylindrical shape and rotates about its center. Then, the deflector irradiates the surface of the photoconductor drum with a light beam emitted from each of the plurality of light emitting elements, and moves the irradiation position of the laser beam with respect to the surface of the photoconductor drum in a direction along the rotation axis of the photoconductor drum. Then, the driver receives the input of a second control signal which is an analog signal different from the plurality of first control signals, in addition to the plurality of first control signals described above. Moreover, as described above, the driver controls the light emitting power of a corresponding light emitting element on the basis of the signal level of each of the plurality of first control signals. In addition, the driver uniformly controls the light emitting power of each of the plurality of light emitting elements on the basis of the signal level of the second control signal, that is, uniformly controls the light emitting power of each of all the light emitting elements. Here, the second control signal includes a second correction component for equalizing the irradiation intensity of the light beam to the surface of the photoconductor drum in the direction along the rotation axis of the photoconductor drum, a so-called main scanning direction. Then, the aforementioned predetermined level changes in accordance with the irradiation position of the light beam with respect to the surface of the photoconductor drum in the direction in which the photoconductor drum rotates, that is, a so-called sub-scanning direction.

In such a configuration, specifically a configuration in which the second control signal is included as an element, a second generator is further provided. The second generator generates the second control signal. Specifically, the second generator includes a third pulse generator and a third filter. The third pulse generator generates a third pulse signal which is a pulse density modulation signal according to the second correction value for setting the signal level of the second control signal including the aforementioned second correction component. Then, the third filter applies low-pass filter processing to the third pulse signal to thereby generate the second control signal.

Apart from this, there may be a configuration in which the second control signal is not included as an element, for example, a configuration in which each of the plurality of first control signals includes a second correction component. In this case, the correction parallel unit, particularly the first multiplier digitally multiplies together a second correction value for exhibiting the second correction component in addition to the predetermined value and the first correction value described above. Then, the first pulse generator generates a first pulse signal which is a pulse density modulation signal according to the multiplication result by the first multiplier. Then, the first filter applies low-pass filter processing to the first pulse signal to thereby generate the first control signal including the first correction component and the second correction component.

On the contrary to such correction parallel unit, the specific generator generates a first control signal that does not include the first correction component but includes the second correction component.

Specifically, the specific generator includes a second multiplier a fourth pulse generator, and a fourth filter. The second multiplier digitally multiplies the predetermined value and the second correction value described above together. Then, the fourth pulse generator generates a fourth pulse signal which is a pulse density modulation signal according to the multiplication result by the second multiplier. The fourth filter applies low-pass filter processing to the fourth pulse signal to thereby generate the first control signal that does not include the first correction component but includes the second correction component.

Such a specific generator may further include a first rounding processor. This first rounding processor performs rounding processing on a multiplication result by the second multiplier to thereby shorten a data length of the multiplication result by the second multiplier. In this case, the aforementioned fourth pulse generator generates a pulse density modulation signal according to data after the rounding processing by the first rounding processor as the fourth pulse signal.

Moreover, in a case where the correction parallel unit, particularly the first multiplier digitally multiplies together a second correction value for exhibiting the second correction component in addition to the predetermined value and the first correction value as described above, the correction parallel unit may further include a second rounding processor. This second rounding processor performs rounding processing on a multiplication result by the first multiplier to thereby shorten a data length of the multiplication result by the first multiplier. Then, the aforementioned first pulse generator generates a pulse density modulation signal according to data after the rounding processing by the second rounding processor as the first pulse signal.

In the first aspect, a storage may be further provided. This storage stores the predetermined value, first correction value, and second correction value described above, and particularly collectively stores them. In other words, the predetermined value, first correction value, and second correction value are stored in one (common) storage.

An image forming apparatus according to the second aspect of the present invention is an electrophotographic image forming apparatus, and includes the multi-beam light source driving device, photoconductor drum, and deflector according to the first aspect. The photoconductor drum has a substantially cylindrical shape and rotates about its center. Then, the deflector irradiates the surface of the photoconductor drum with a light beam emitted from each of the plurality of light emitting elements, and moves the irradiation position of the laser beam with respect to the surface of the photoconductor drum in a direction along the rotation axis of the photoconductor drum.

A multi-beam light source driving method according to the third aspect of the present invention is a method for driving a multi-beam light source including a plurality of light emitting elements, and includes firstly generating and firstly inputting. In the firstly generating, a plurality of first control signals which are a plurality of analog signals individually corresponding to the plurality of light emitting elements are individually generated. Then, in the firstly inputting, the plurality of first control signals generated by the firstly generating are input to a driver. When the plurality of first control signals are input, the driver controls the light emitting power of a corresponding light emitting element on the basis of the signal level of each of the plurality of first control signals. Here, some or all of the plurality of first control signals include a first correction component for correcting the variation in the light emitting power between the plurality of light emitting elements due to the individual difference of each of the plurality of light emitting elements, that is, a relative output difference. In order to generate the first control signals including such a first correction component, the firstly generating includes firstly multiplying, firstly generating a first pulse signal, and firstly filtering. The firstly multiplying digitally multiplies a predetermined value for setting the signal level of the first control signal to a predetermined level and a first correction value for exhibiting the first correction component together. Then, the firstly generating a first pulse signal generates a first pulse signal which is a pulse density modulation signal according to the multiplication result by the firstly multiplying. The firstly filtering applies low-pass filter processing to the first pulse signal to thereby generate the first control signal including the first correction component.

Effect of the Invention

According to the present invention, in a multi-beam light source driving device for driving a multi-beam light source, an image forming apparatus including the multi-beam light source driving device, and a multi-beam light source driving method, the relative output difference of a plurality of light emitting elements can be corrected with a simple configuration.

DESCRIPTION OF THE PREFERRED EMBODIMENTS

First Embodiment

Figure 1:
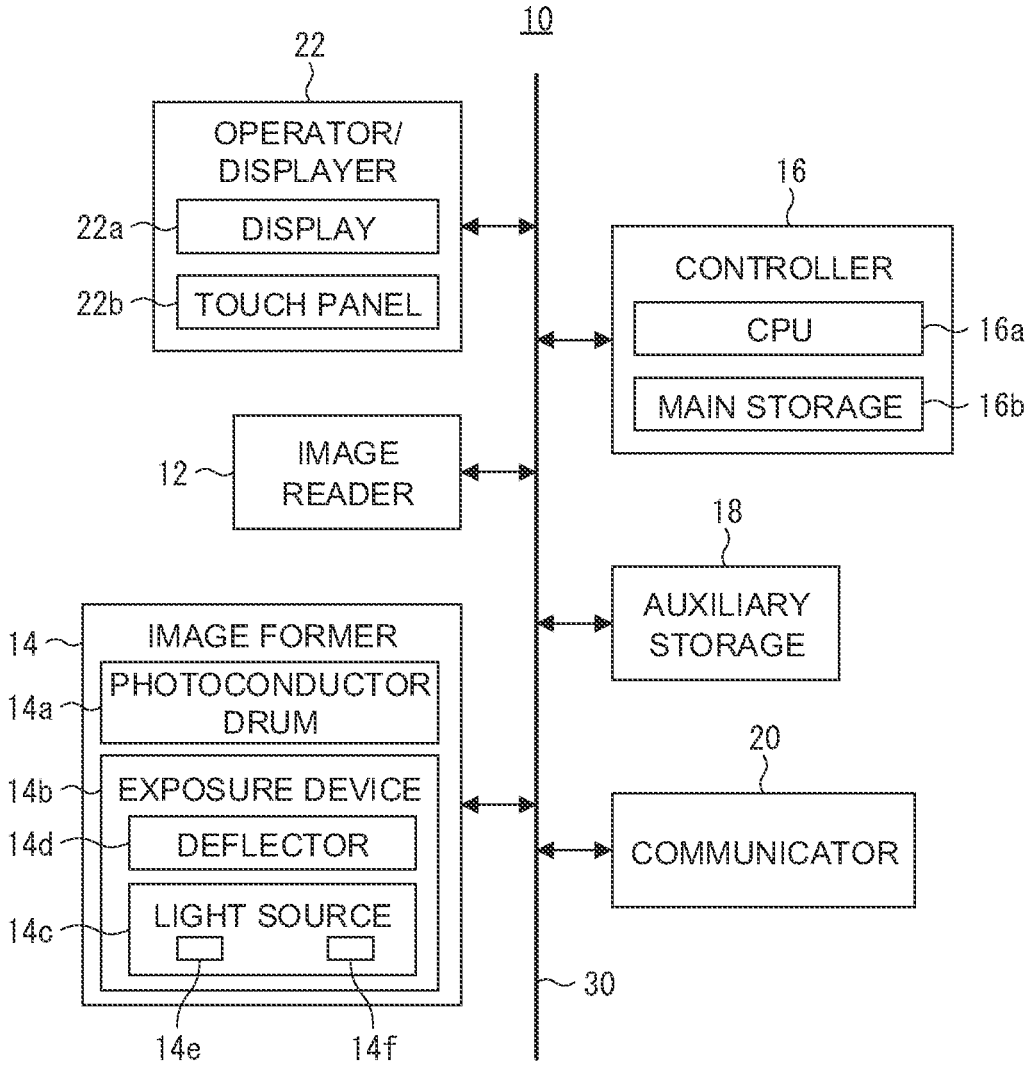
FIG. 1 is a block diagram illustrating an electrical configuration of a multifunction peripheral according to a first embodiment of the present invention.

A first embodiment of the present invention is described by using a multifunction peripheral (MFP) 10 illustrated in FIG. 1 as an example.

The multifunction peripheral 10 according to the first embodiment has a plurality of functions such as a copy function, a printer function, an image scanner function, and a fax function. Therefore, the multifunction peripheral 10 includes an image reader 12, an image former 14, a controller 16, an auxiliary storage 18, a communicator 20, and an operator/displayer 22. These are connected via a bus 30 that is common to each of the above components.

The image reader 12 is an example of an image reader. That is, the image reader 12 is responsible for image reading processing that reads an image of a document (not illustrated) and outputs two-dimensional read image data corresponding to the image of the document. Such an image reader 12 includes a document table (not illustrated) on which the document (not illustrated) is placed. The document table is formed of a transparent hard member such as rectangular flat glass. An image reading unit including a light source, a mirror, a lens, a line sensor, and the like (not illustrated) and a drive mechanism (not illustrated) for moving an image reading position by the image reading unit are provided below the document table. Then, above the document table, a document pressing cover (not illustrated) for pressing the document placed on the document table is provided. The document pressing cover may include an automatic document feeder (ADF) (not illustrated), which is an optional device.

The image former 14 is an example of an image former. That is, the image former 14 is responsible for image forming processing that forms an image based on appropriate image data such as the read image data output from the image reader 12 on a sheet-shaped image recording medium such as a paper (not illustrated). This image forming processing is performed by a known electrophotographic method. Therefore, the image former 14 includes a photoconductor drum 14*a* which is a substantially cylindrical photoconductor, and an exposure device 14*b* as an exposer. In particular, the exposure device 14*b* includes a light source 14*c* as a light source and a deflector 14*d* as a deflector. Furthermore, the light source 14*c* includes a non-volatile semiconductor memory as a storage such as an EEPROM (Electrically Erasable Programmable Read Only Memory) 14*e* and an integrated circuit as a circuit configurer such as an ASIC (Application Specific Integrated Circuit) 14*f*. In addition, the image former 14 includes a charging device as a charger (not illustrated), a developing device as a developer, a transfer device as a transferer, a fixing device as a fixer, a cleaning device as a cleaner, a static elimination device as a static eliminator, and the like. The image recording medium, so to speak, a printed matter after the image is formed through the image forming processing by the image former 14 is discharged to a paper discharge tray (not illustrated). In FIG. 1, for convenience of explanation including illustration, the photoconductor drum 14*a* and the exposure device 14*b* are illustrated one by one, but four of these are actually provided corresponding to the four-color components of the CMYK color model for the purpose of implementing color image forming processing. Moreover, the charging device, developing device, transfer device, fixing device, cleaning device, static elimination device, and the like are also provided four by four.

The controller 16 is an example of a controller that controls the overall control of the multifunction peripheral 10. Therefore, the controller 16 includes a computer as a control executer, for example, a CPU (central processing unit) 16*a*. In addition, the controller 16 includes a main storage 16*b* as a main storer that the CPU 16*a* can directly access. The main storage 16*b* includes a ROM (read only memory) (not illustrated) and a RAM (random access memory) (not illustrated). A control program (firmware) for controlling the operation of the CPU 16*a* is stored in the ROM. The RAM constitutes a work area, a buffer area, and the like when the CPU 16*a* executes processing based on the control program.

The auxiliary storage 18 is an example of an auxiliary storage.

Various data such as the read image data output from the image reader 12 are appropriately stored in the auxiliary storage 18. Such an auxiliary storage 18 includes, for example, a hard disk drive (not illustrated). Moreover, the auxiliary storage 18 may include a rewritable non-volatile memory such as a flash memory.

The communicator 20 is an example of a communicator. This communicator 20 is connected to a communication network (not illustrated) and thereby is responsible for bidirectional communication via the communication network. The communication network mentioned here includes a LAN (local area network), the Internet, and a public switched telephone network. Moreover, the LAN includes a wireless LAN (a wireless LAN according to the IEEE 802.11 standard, so-called Wi-Fi (registered trademark)).

The operator/displayer 22 is a so-called operation panel, and includes a display 22*a* as an example of a displayer and a touch panel 22*b* as an example of an operation receiver. The display 22*a* has a substantially rectangular display surface, and the touch panel 22*b* is provided so as to overlap the display surface of the display 22*a*. The display 22*a* is, for example, a liquid crystal display (LCD), but is not limited to this, and may be an other type of display such as an organic electroluminescence (EL) display. In addition, the touch panel 22*b* is, for example, an electrostatic capacitance type panel, but is not limited to this, and may be an other type of panel such as an electromagnetic induction type, a resistance film type, and an infrared type. Moreover, the operator/displayer 22 includes an appropriate light emitter such as a light emitting diode (LED) (not illustrated). In addition, the operator/displayer 22 includes an appropriate hardware switcher such as a push button switch (not illustrated).

According to the multifunction peripheral 10 according to the first embodiment, in particular, according to the image former 14, the image forming processing by the electrophotographic method is performed as described above. That is, charging processing is performed by the charging device, and static electricity is thereby applied to the surface of the photoconductor drum 14*a*. Then, exposure processing is performed by the exposure device 14*b*, and a latent image is thereby formed on the surface of the photoconductor drum 14*a*. Furthermore, developing processing is performed by the developing device, and toner thereby adheres to the latent image on the surface of the photoconductor drum 14*a*, and a toner image is formed. Then, transfer processing is performed by the transfer device, and the toner image on the surface of the photoconductor drum 14*a* is thereby transferred to an image recording medium. The image recording medium on which the toner image has been transferred is further subjected to fixing processing by the fixing device, and the toner image is thereby fixed on the image recording medium. As a result, an image is formed on the image recording medium. After that, cleaning processing is performed by the cleaning device, and the toner remaining on the surface of the photoconductor drum 14*a* is thereby removed. Then, static elimination processing is performed by the static elimination device, and the static electricity remaining on the surface of the photoconductor drum 14*a* is removed.

Figure 2:
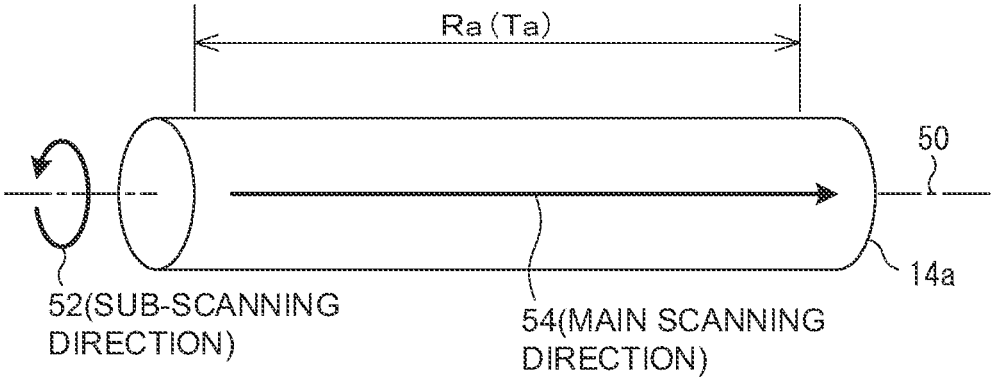
FIG. 2 is a diagram schematically illustrating a photoconductor drum in the first embodiment.

Here, as illustrated in FIG. 2, the photoconductor drum 14*a* rotates about a straight line 50 passing through the center of the photoconductor drum 14*a*, and rotates in the direction indicated by an arrow 52, for example. The surface of the photoconductor drum 14*a* is irradiated with a laser beam emitted from a light source 14*c* of the exposure device 14*b*. In addition, the irradiation position (laser spot) of the laser beam with respect to the surface of the photoconductor drum 14*a* is moved at a constant speed in the direction along a rotation axis 50 of the photoconductor drum 14*a*, for example, in the direction indicated by an arrow 54. The deflector 14*d* of the exposure device 14*b* is responsible for moving the irradiation position of the laser beam in the direction indicated by the arrow 54. Therefore, the deflector 14*d* includes an optical system element including various mirrors such as a polygon mirror (not illustrated) and various lenses such as an fθ lens. In this way, the surface of the photoconductor drum 14*a* rotating in the direction indicated by the arrow 52 is irradiated with the laser beam, and the irradiation position of the laser beam with respect to the surface of the photoconductor drum 14*a* is moved in the direction indicated by the arrow 54. As a result, a two-dimensional latent image is formed on the surface of the photoconductor drum 14*a*.

The direction indicated by the arrow 54, that is, the direction along the rotation axis 50 of the photoconductor drum 14*a* is defined as a main scanning direction. Then, the direction indicated by the arrow 52, that is, the rotation direction of the photoconductor drum 14*a* is defined as a sub-scanning direction. The time required for the irradiation position of the laser beam to move in an effective exposure area Ra on the surface of the photoconductor drum 14*a* in the main scanning direction, so to speak, a main scanning time Ta is, for example, approximately 160 μs. On the other hand, the moving speed (relative speed) of the irradiation position of the laser beam with respect to the surface of the photoconductor drum 14*a* in the sub-scanning direction is appropriately determined by the rotation speed of the photoconductor drum 14*a*.

Moreover, although not illustrated, a BD (Beam Detect) sensor for detecting the laser beam is disposed at an appropriate position on the upstream side of the photoconductor drum 14*a* in the main scanning direction. The irradiation position of the laser beam in the main scanning direction is estimated on the basis of a BD signal output from this BD sensor, and thus various timings in the main scanning direction are measured. On the other hand, regarding the sub-scanning direction, for example, in a case where the rotation driver that is responsible for driving the rotation of the photoconductor drum 14*a* is a stepping motor, the rotation angle position (rotation angle) of the photoconductor drum 14*a* is obtained on the basis of a motor control signal (drive pulse) for controlling the stepping motor, and thus the irradiation position of the laser beam is estimated. Alternatively, for example, in a case where a rotation angle position detector such as a rotary encoder for detecting the rotation angle position of the photoconductor drum 14*a* is provided, the irradiation position of the laser beam in the sub-scanning direction is estimated on the basis of a rotation angle position detecting signal output from the rotation angle position detector.

Figure 3:
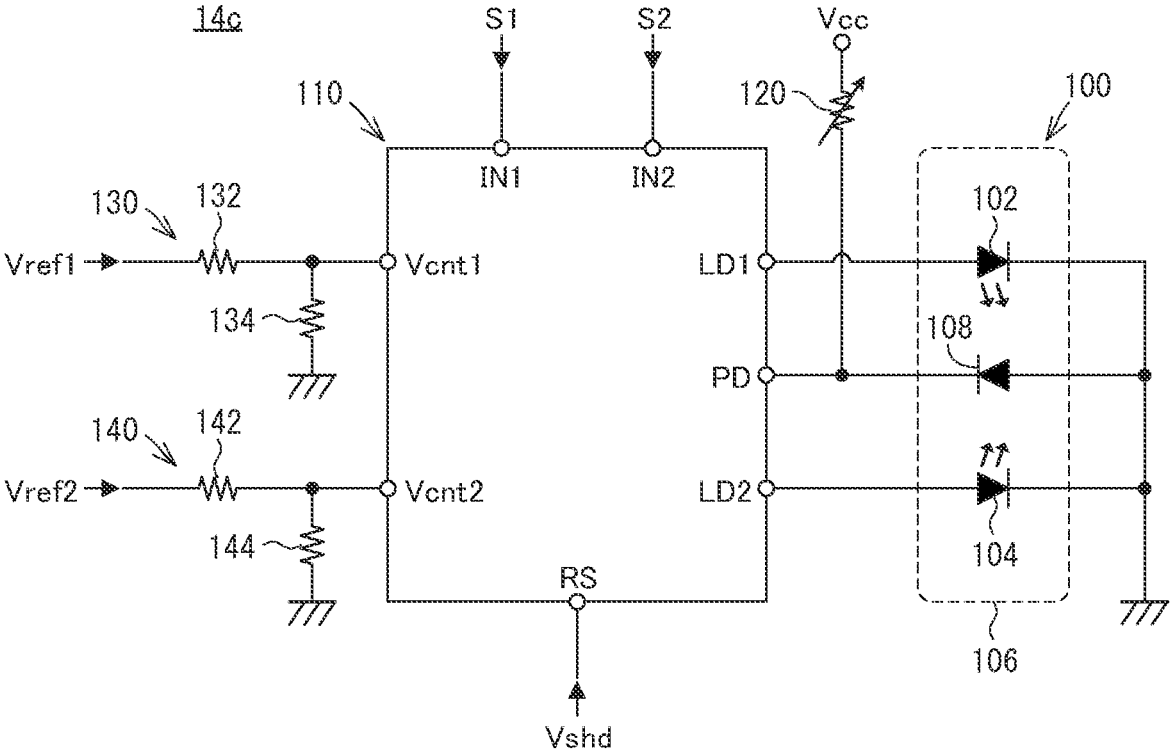
FIG. 3 is a diagram illustrating an electrical configuration of a light source in the first embodiment.

As illustrated in FIG. 3, the light source 14*c* includes a monolithic multi-beam light source 100. That is, the multi-beam light source 100 includes a plurality of, for example, two laser diodes 102 and 104 as light emitting elements. These two laser diodes 102 and 104 are housed in one (common) CAN package 106. In addition, the CAN package 106 is provided with a photodiode 108. The photodiode 108 is a light receiving element for monitoring the light emitting power of each of the laser diodes 102 and 104, and one photodiode 108 is configured to be able to individually monitor the light emitting power of each of the laser diodes 102 and 104.

The laser diodes 102 and 104 are individually driven by a laser driver 110 described below to individually emit laser beam. That is, two laser beams are (sometimes) emitted from the light source 14*c* at the same time. These two laser beams are irradiated so as to be aligned adjacent to the surface of the photoconductor drum 14*a* in the sub-scanning direction, so to speak, so as to form two lines (scanning lines). Strictly speaking, in the sub-scanning direction, the laser beam emitted from a first laser diode 102, which is one laser diode, is irradiated to the upstream side, and the laser beam emitted from a second laser diode 104, which is the other laser diode, is irradiated to the downstream side, so as to form the next line.

The laser driver 110 is a two-channel compatible commercially available integrated circuit capable of individually driving two laser diodes 102 and 104. Specifically, the laser driver 110 includes two drive terminals LD1 and LD2. These two drive terminals LD1 and LD2 are terminals that individually supply electric power to the laser diodes 102 and 104. Therefore, for example, a first laser diode 102 is connected to a first drive terminal LD1 which is one (first channel) drive terminal, and more specifically, the anode terminal of the first laser diode 102 is connected. Then, a second laser diode 104 is connected to a second drive terminal LD2 which is the other (second channel) drive terminal, and more specifically, the anode terminal of the second laser diode 104 is connected. The cathode terminals of the laser diodes 102 and 104 are connected to the ground which is the reference potential.

In addition, the laser driver 110 includes a monitor terminal PD. This monitor terminal PD is a terminal that receives an input of a monitor signal output from the photodiode 108. Therefore, the photodiode 108 is connected to the monitor terminal PD, and more specifically, the cathode terminal of the photodiode 108 is connected. Then, the anode terminal of the photodiode 108 is connected to the ground. Furthermore, the cathode terminal of the photodiode 108, in other words, the monitor terminal PD of the laser driver 110 is connected to a DC power supply line Vcc via a variable resistor 120. The variable resistor 120 is a manual adjuster for adjusting the signal level of the monitor signal output from the photodiode 108, in other words, for adjusting the sensitivity of the photodiode 108.

Additionally, the laser driver 110 includes two image signal input terminals IN1 and IN2. These two image signal input terminals IN1 and IN2 are terminals that individually receive inputs of image signals S1 and S2 for two lines based on image data used for image forming processing (exposure processing). These two image signal input terminals IN1 and IN2 correspond individually to the drive terminals LD1 and LD2, that is, correspond to the laser diodes 102 and 104 individually. For example, the first image signal input terminal IN1 which is one image signal input terminal corresponds to the first drive terminal LD1, that is, corresponds to the first laser diode 102. Then, the second image signal input terminal IN2 which is the other image signal input terminal corresponds to the second drive terminal LD2, that is, corresponds to the second laser diode 104. Each of the image signals S1 and S2 is a signal appropriately modulated by a modulation circuit (not illustrated), and is, for example, a pulse width modulation (PWM) signal.

Moreover, the laser driver 110 includes two output control terminals Vcnt1 and Vcnt2. These two output control terminals Vcnt1 and Vcnt2 are terminals that individually receive the inputs of two reference signals Vref1 and Vref2 for individually controlling the light emitting power of each of the laser diodes 102 and 104. For example, a first output control terminal Vcnt1 which is one output control terminal corresponds to the first laser diode 102. A first reference signal Vref1 for controlling the light emitting power of the first laser diode 102 is input to the first output control terminal Vcnt1. Then, a second output control terminal Vcnt2 which is the other output control terminal corresponds to the second laser diode 104. A second reference signal Vref2 for controlling the light emitting power of the second laser diode 104 is input to the second output control terminal Vcnt2. Strictly speaking, the first reference signal Vref1 is input to the first output control terminal Vcnt1 via a voltage dividing circuit 130, more specifically via a first voltage dividing circuit 130 including two fixed resistors 132 and 134. Then, the second reference signal Vref2 is input to the second output control terminal Vcnt2 via a voltage dividing circuit 140 similar to (having same specifications of) the first voltage dividing circuit 130, more specifically via a second voltage dividing circuit 140 including two fixed resistors 142 and 144.

Furthermore, the laser driver 110 includes an output current setting terminal RS. The output current setting terminal RS is a terminal that receives an input of an output current setting signal for uniformly controlling the current (output current) flowing through the laser diodes 102 and 104. The current flowing through the laser diodes 102 and 104 is uniformly controlled in accordance with the signal level of the output current setting signal input to the output current setting terminal RS, and thus the light emitting power of each of the laser diodes 102 and 104 is controlled uniformly. In the first embodiment, a shading correction signal Vshd, which will be described later, is input to the output current setting terminal RS as the output current setting signal.

According to the light source 14*c* having such a configuration, the laser driver 110 drives the first laser diode 102 on the basis of a so-called first image signal S1 input to the first image signal input terminal IN1, and more specifically turns on/off the supply of electric power to the first laser diode 102. In addition, the laser driver 110 drives the second laser diode 104 on the basis of a so-called second image signal S2 input to the second image signal input terminal IN2, and more specifically turns on/off the supply of electric power to the second laser diode 104.

Then, the laser driver 110 controls the light emitting power of the first laser diode 102 on the basis of the signal (voltage) level of the first reference signal Vref1 which is input to the first output control terminal Vcnt1, strictly speaking, input to the first output control terminal Vcnt1 via the first voltage dividing circuit 130. The light emitting power of the first laser diode 102 is proportional to the signal level of the first reference signal Vref1. In addition, the laser driver 110 controls the light emitting power of the second laser diode 104 on the basis of the signal level of the second reference signal Vref2 which is input to the second output control terminal Vcnt2, strictly speaking, input to the second output control terminal Vcnt2 via the second voltage dividing circuit 140. The light emitting power of the second laser diode 104 is proportional to the signal level of the second reference signal Vref2.

Furthermore, the laser driver 110 uniformly controls the light emitting power of each of the laser diodes 102 and 104 on the basis of the signal level of the shading correction signal Vshd input to the output current setting terminal RS. That is, the light emitting power of each of the laser diodes 102 and 104 is also proportional, more specifically uniformly proportional, to the signal level of the shading correction signal Vshd.

The laser driver 110 has an automatic power control (APC) function. According to this APC function, when the signal levels of the first reference signal Vref1 and the second reference signal Vref2 are constant and the signal level of the shading correction signal Vshd is 0 V, the light emitting power of each of the laser diodes 102 and 104 is controlled to be constant. The light emitting power of each of the laser diodes 102 and 104 is monitored by the photodiode 108, and more specifically, is recognized on the basis of the signal level of the monitor signal input from the photodiode 108 to the monitor terminal PD. Moreover, as an alternative to the monitor signal from the photodiode 108, it is also possible to recognize the light emitting power of each of the laser diodes 102 and 104 on the basis of the signal level of the BD signal from the BD sensor described above.

This APC function is enabled during the so-called ineffective period in the main scanning direction when the irradiation position of the laser beam with respect to the surface of the photoconductor drum 14*a* is not in the effective exposure area Ra in the main scanning direction. Therefore, the laser driver 110 includes an enable terminal (not illustrated) that receives an input of an enable signal for instructing the enabling and disabling of the APC function. Meanwhile, when the APC function is enabled, that is, during the ineffective period in the main scanning direction, the signal level of the shading correction signal Vshd needs to be 0 V as described above. Therefore, when the APC function is enabled, it becomes impossible to uniformly control the light emitting power of each of the laser diodes 102 and 104 by the shading correction signal Vshd. In other words, the light emitting power of each of the laser diodes 102 and 102 is uniformly controlled by the shading correction signal Vshd only when the APC function is disabled, that is, only during the so-called effective period in the main scanning direction.

In the main scanning direction, the irradiation intensity of the laser beam on the surface of the photoconductor drum 14*a* becomes non-uniform, and so-called shading occurs. This shading is due to the characteristics of the deflector 14*d*, particularly the characteristics of the optical elements described above. Moreover, also in the sub-scanning direction, the charging power on the surface of the photoconductor drum 14*a* and the influence of the laser beam on the surface change due to the difference (distribution) of the surface temperature of the photoconductor drum 14*a*, and non-uniformity may occur in the quality of the image forming processing including exposure processing. According to the light source 14*c* having the configuration illustrated in FIG. 3, the shading that is non-uniform in the main scanning direction and the non-uniformity in the sub-scanning direction can be corrected individually (independently).

For example, with regard to shading, a correction value for correcting the shading is obtained in advance by an experiment or the like and stored in an EEPROM 14*e*. The correction value stored in the EEPROM 14*e*, so to speak, a shading correction value, is sequentially read from the EEPROM 14*e* in accordance with the irradiation position of the laser beam with respect to the surface of the photoconductor drum 14*a* in the main scanning direction. Then, the correction value read from the EEPROM 14*e* is converted from a digital signal to an analog signal. This analog signal is input to the output current setting terminal RS of the laser driver 110 as the shading correction signal Vshd. The light emitting power of each of the laser diodes 102 and 104 is uniformly controlled on the basis of the signal level of the shading correction signal Vshd. As a result, the shading is corrected.

On the other hand, with regard to the non-uniformity in the sub-scanning direction, even if there are factors such as a difference in the surface temperature of the photoconductor drum 14*a* in the sub-scanning direction, a reference value for keeping the quality of the image forming processing including exposure processing constant, in other words, for producing such a result, can be obtained in advance by an experiment or the like. This so-called sub-scanning reference value is also stored in the EEPROM 14*e*. This sub-scanning reference value stored in the EEPROM 14*e* is read from the EEPROM 14*e* in accordance with the irradiation position of the laser beam with respect to the surface of the photoconductor drum 14*a* in the sub-scanning direction. Then, the sub-scanning reference value read from the EEPROM 14*e* is converted from a digital signal to an analog signal. This analog signal is input to the first output control terminal Vcnt1 of the laser driver 110 as the first reference signal Vref1 via the voltage dividing circuit 130. In addition, an analog signal corresponding to a position different by one line to the downstream side in the sub-scanning direction from the first reference signal Vref1 is input to the second output control terminal Vcnt2 of the laser driver 110 as the second reference signal Vref2 via the voltage dividing circuit 140. As a result, the light emitting power of the first laser diode 102 is controlled on the basis of the signal level of the first reference signal Vref1, and the light emitting power of the second laser diode 104 is controlled on the basis of the signal level of the second reference signal Vref2. As a result, the non-uniformity in the sub-scanning direction is corrected.

Figure 4:
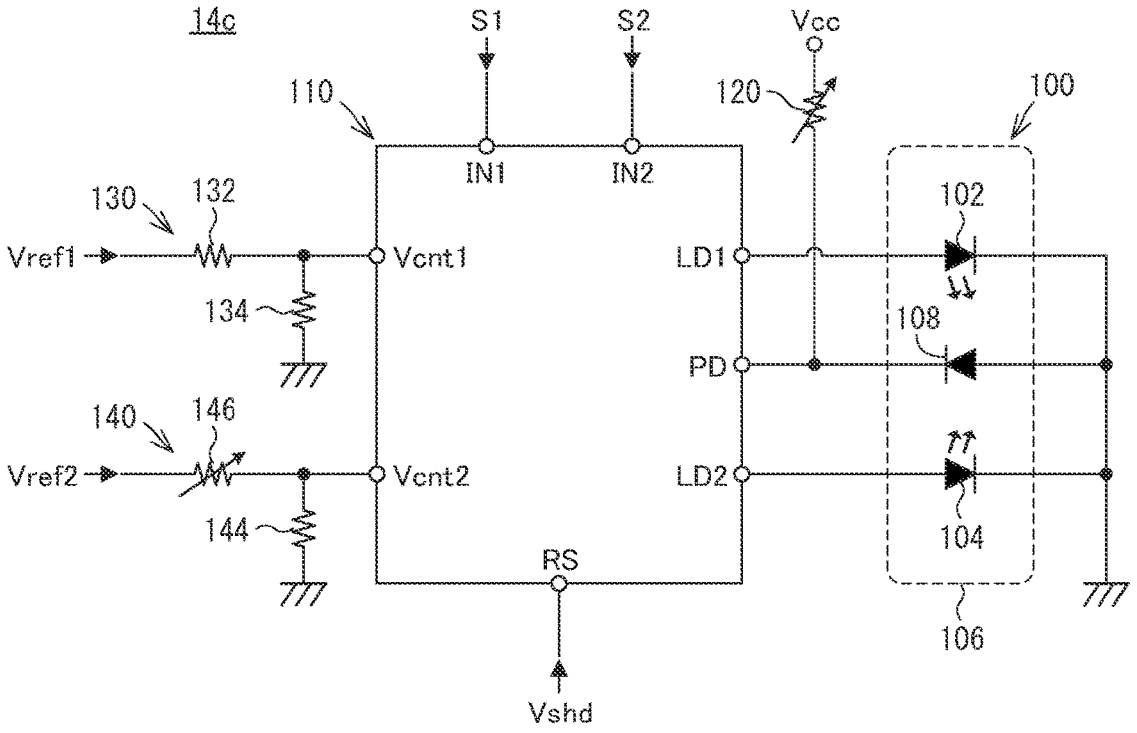
FIG. 4 is a diagram illustrating an example of a comparison target of the light source in the first embodiment.

Even if the first laser diode 102 and the second laser diode 104 are driven under the same conditions, due to the individual difference of each of the first laser diode 102 and the second laser diode 104, there may be variations in the light emitting power between the two, and a so-called relative output difference may occur. In order to correct this relative output difference, a configuration as illustrated in FIG. 4, for example, is conventionally adopted. That is, by adopting a configuration including a variable resistor 146 as the voltage dividing circuit 140, the voltage dividing ratio by the voltage dividing circuit 140, that is, the signal level of the second reference signal Vref2 input to the second output control terminal Vcnt2 can be changed.

According to the configuration illustrated in FIG. 4, first, as the first image signal S1, a test image signal of a constant signal level is input to the first image signal input terminal IN1. On the other hand, the second image signal S2 is not input to the second image signal input terminal IN2. In addition, the signal level of the first reference signal Vref1 is set to a predetermined test level. On the other hand, the signal level of the second reference signal Vref2 is set to 0 V. Furthermore, the signal level of the shading correction signal Vshd is set to 0 V. In this state, the variable resistor 120 is adjusted in such a manner that the signal level of the monitor signal input from the photodiode 108 to the monitor terminal PD becomes a predetermined monitor reference level.

Subsequently, as the second image signal S2, the aforementioned test image signal is input to the second image signal input terminal IN2. On the other hand, the first image signal S1 is not input to the first image signal input terminal IN1. In addition, the signal level of the second reference signal Vref2 is set to the aforementioned predetermined test level. On the other hand, the signal level of the first reference signal Vref1 is set to 0 V. Furthermore, the signal level of the shading correction signal Vshd is set to 0 V. In this state, the variable resistor 146 constituting the voltage dividing circuit 140 is adjusted in such a manner that the signal level of the monitor signal input from the photodiode 108 to the monitor terminal PD becomes the aforementioned monitor reference level. In this way, the relative output difference between the first laser diode 102 and the second laser diode 104 is corrected.

However, in the configuration illustrated in FIG. 4, as compared with the configuration illustrated in FIG. 3, the voltage dividing circuit 140 including the variable resistor 146 is adopted, that is, the variable resistor 146 is provided. Therefore, the light source 14*c* (particularly the printed wiring board (not illustrated)) becomes large and expensive. In order to eliminate this inconvenience, in the first embodiment, the configuration illustrated in FIG. 3, that is, the configuration not including the variable resistor 146 is adopted, and then the relative output difference between the first laser diode 102 and the second laser diode 104 is corrected by digital calculation.

Figure 5:
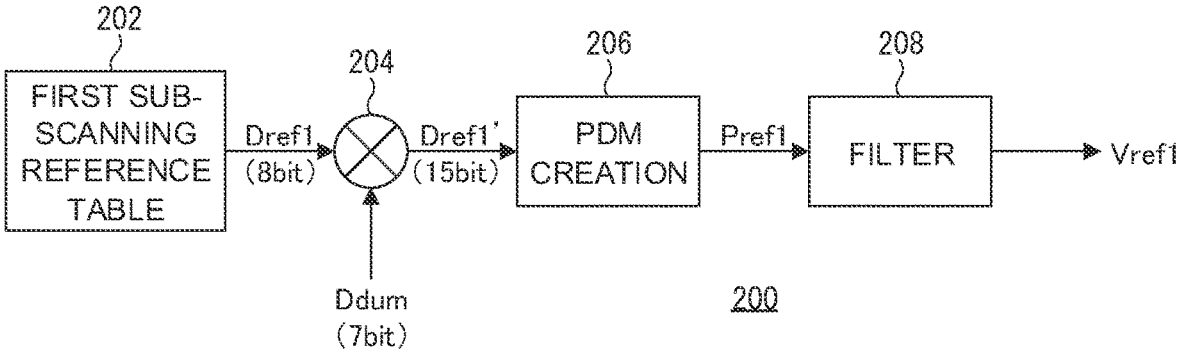
FIG. 5 is a diagram illustrating a configuration of a first reference signal generation circuit in the first embodiment.

Specifically, in order to generate the first reference signal Vref1, a first reference signal generation circuit 200 such as that illustrated in FIG. 5 is provided. The first reference signal generation circuit 200 includes a first sub-scanning reference table 202. In the first sub-scanning reference table 202, the aforementioned sub-scanning reference value, that is, the sub-scanning reference value for keeping the quality of the image forming processing including exposure processing constant in the sub-scanning direction is stored. That is, the sub-scanning reference values are stored in the EEPROM 14*e* in a state of being collected in the first sub-scanning reference table 202.

The sub-scanning reference value stored in the first sub-scanning reference table 202 (EEPROM 14*a*) is, as described above, read from the first sub-scanning reference table 202 in accordance with the irradiation position of the laser beam with respect to the surface of the photoconductor drum 14*a* in the sub-scanning direction. Then, the sub-scanning reference value read from the first sub-scanning reference table 202, so to speak, first sub-scanning reference data Dref1 is input to a multiplication circuit 204. The first sub-scanning reference data Dref1 is, for example, an 8-bit digital signal.

In addition, dummy data Ddum is input to the multiplication circuit 204. This dummy data Ddum is data for aligning the data length of the first sub-scanning reference data Dref1 with the data length of second sub-scanning reference data Dref2, which will be described later, and is a 7-bit digital signal representing a decimal number "1". This dummy data Ddum is generated by, for example, the aforementioned ASIC 14*f*. In other words, a dummy generation circuit (not illustrated) for generating the dummy data Ddum includes the ASIC 14*f*. The ASIC 14*f* constitutes not only a dummy generation circuit but also various circuits necessary for the exposure device 14*b* including the light source 14*c*. That is, the dummy generation circuit includes a part of the ASIC 14*f*.

The multiplication circuit 204 multiplies the first sub-scanning reference data Dref1 and the dummy data Ddum input to the multiplication circuit 204 together by so-called digital calculation. Since such a multiplication circuit 204 is implemented by a known technique, the detailed description thereof will be omitted. First sub-scanning reference data Dref1' after the multiplication by the multiplication circuit 204 is input to a PDM generation circuit 206. The first sub-scanning reference data Dref1' after the multiplication by the multiplication circuit 204 is a 15-bit (=8-bit+7-bit) digital signal. The multiplication circuit 204 also includes the ASIC 14*f*, that is, a part of the ASIC 14*f*.

The PDM generation circuit 206 generates a PDM signal Pref1 which is a signal of a pulse train according to the first sub-scanning reference data Dref1' input to the PDM generation circuit 206. Such a PDM generation circuit 206 is also implemented by a known technique, and thus the detailed description thereof will be omitted. The PDM signal Pref1 generated by the PDM generation circuit 206 is input to a filter circuit 208. The PDM generation circuit 206 also includes the ASIC 14*f*, that is, a part of the ASIC 14*f*.

The filter circuit 208 is, for example, an RC low-pass filter circuit having one or more stages, and performs low-pass filter processing on the PDM signal Pref1 input to the filter circuit 208. As a result, the PDM signal Pref1 is converted into an analog signal, that is, an analog signal of a signal level according to the aforementioned sub-scanning reference value is generated. This analog signal is input to the first output control terminal Vcnt1 of the laser driver 110 as the first reference signal Vref1 via the voltage dividing circuit 130. The filter circuit 208 is not limited to the RC low-pass filter circuit, and may be an LC low-pass filter circuit, an active filter circuit, or the like, but the RC low-pass filter is suitable from the viewpoint of simplicity of circuit configuration and cost.

Figure 6:
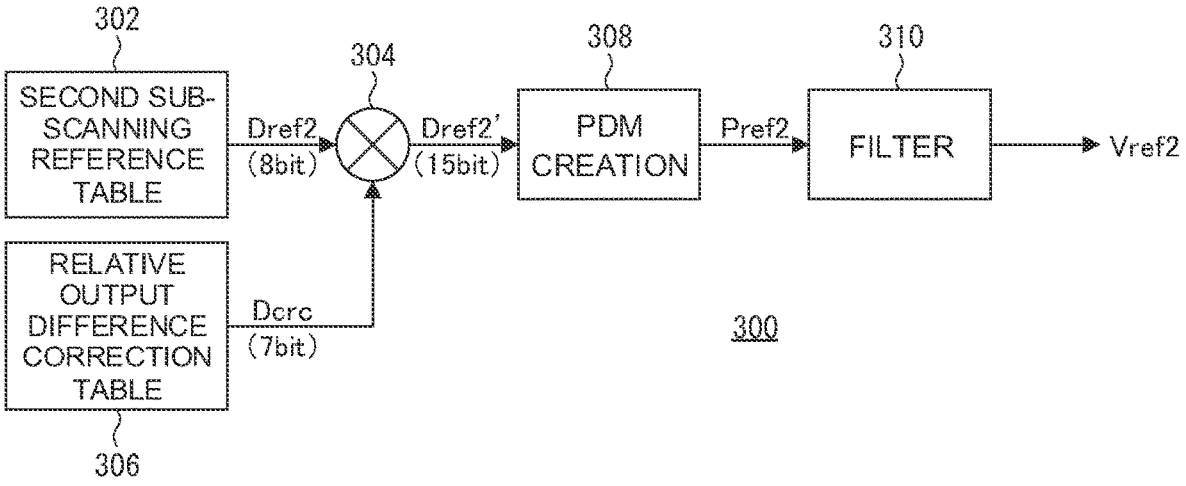
FIG. 6 is a diagram illustrating a configuration of a second reference signal generation circuit in the first embodiment.

Moreover, in order to generate the second reference signal Vref2, a second reference signal generation circuit 300 such as that illustrated in FIG. 6 is provided. The second reference signal generation circuit 300 includes a second sub-scanning reference table 302. The sub-scanning reference value is stored in the second sub-scanning reference table 302 as in the first sub-scanning reference table 202 of the first reference signal generation circuit 200. That is, the sub-scanning reference values are stored in the EEPROM 14*e* in a state of being collected in the second sub-scanning reference table 302 separately from the first sub-scanning reference table 202.

The sub-scanning reference value stored in the second sub-scanning reference table 302 (EEPROM 14*e*) is, as described above, read from the second sub-scanning reference table 302 in accordance with the irradiation position of the laser beam with respect to the surface of the photoconductor drum 14*a* in the sub-scanning direction. Strictly speaking, the sub-scanning reference value corresponding to the line next to the sub-scanning reference value read from the first sub-scanning reference table 202 is read from the second sub-scanning reference table 302. Then, the sub-scanning reference value read from the second sub-scanning reference table 302, so to speak, second sub-scanning reference data Dref2 is input to a multiplication circuit 304. The second sub-scanning reference data Dref2 is an 8-bit digital signal, similarly to the first sub-scanning reference data Dref1.

In addition, the second reference signal generation circuit 300 includes a relative output difference correction table 306. In this relative output difference correction table 306, a relative output difference correction value for correcting the relative output difference between the first laser diode 102 and the second laser diode 104 described above is stored. This relative output difference correction value is obtained by an experiment in advance. The relative output difference correction table 306 is stored in the EEPROM 14*e*. That is, the relative output difference correction values are stored in the EEPROM 14*e* in a state of being collected in the relative output difference correction table 306.

The relative output difference correction value stored in the relative output difference correction table 306 (EEPROM 14*e*) is read from the relative output difference correction table 306 in synchronization with the reading timing of the sub-scanning reference value from the second sub-scanning reference table 302. Then, the relative output difference correction value read from the relative output difference correction table 306, so to speak, relative output difference correction data Dcrc is input to the multiplication circuit 304. The relative output difference correction data Dcrc is a 7-bit digital signal.

The multiplication circuit 304 multiplies the second sub-scanning reference data Dref2 input to the multiplication circuit 304 and the relative output difference correction data Dcrc together. Such a multiplication circuit 304 is also implemented by a known technique as is the case with the multiplication circuit 204 of the first reference signal generation circuit 200, and thus the detailed description thereof will be omitted. The second sub-scanning reference data Dref2' after the multiplication by the multiplication circuit 304 is input to a PDM generation circuit 308. The second sub-scanning reference data Dref2' after the multiplication by the multiplication circuit 304 is a 15-bit (=8-bit+7-bit) digital signal. The multiplication circuit 304 also includes the ASIC 14*f*.

The PDM generation circuit 308 generates a PDM signal Pref2 which is a signal of a pulse train according to the second sub-scanning reference data Dref2' input to the PDM generation circuit 308. Such a PDM generation circuit 308 is also implemented by a known technique as is the case with the PDM generation circuit 206 of the first reference signal generation circuit 200, and thus the detailed description thereof will be omitted. The PDM signal Pref2 generated by the PDM generation circuit 308 is input to a filter circuit 310. The PDM generation circuit 308 also includes the ASIC 14*f*.

As is the case with the filter circuit 208 of the first reference signal generation circuit 200, the filter circuit 310 is an RC low-pass filter circuit having one or more stages, and performs low-pass filter processing on the PDM signal Pref2 input to the filter circuit 310. As a result, the PDM signal Pref2 is converted into an analog signal, that is, an analog signal of a signal level in which the relative output difference correction value is added to the aforementioned sub-scanning reference value is generated. This analog signal is input to the second output control terminal Vcnt2 of the laser driver 110 as the second reference signal Vref2 via the voltage dividing circuit 140.

Figure 7:
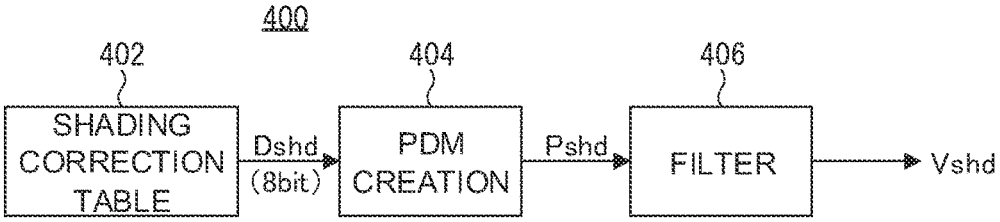
FIG. 7 is a diagram illustrating a configuration of a shading correction signal generation circuit in the first embodiment.

Furthermore, in order to generate the shading correction signal Vshd, a shading correction signal generation circuit 400 such as that illustrated in FIG. 7 is provided. The shading correction signal generation circuit 400 includes a shading correction table 402. The shading correction value described above is stored in the shading correction table 402. That is, the shading correction value is stored in the EEPROM 14*e* in a state of being collected in the shading correction table 402.

The shading correction value stored in the shading correction table 402 (EEPROM 14*e*) is, as described above, sequentially read from the shading correction table 402 in accordance with the irradiation position of the laser beam with respect to the surface of the photoconductor drum 14*a* in the main scanning direction. In other words, the shading correction value stored in the shading correction table 402 is read from the correction table 402 in a cycle shorter than the reading cycle of the sub-scanning reference values from each of the first sub-scanning reference table 202 and the second sub-scanning reference table 302. Then, the shading correction value read from the shading correction table 402, that is, shading correction data Dshd, is input to a PDM generation circuit 404. The shading correction data Dshd is, for example, an 8-bit digital signal.

The PDM generation circuit 404 generates a PDM signal Pshd which is a signal of a pulse train according to the shading correction data Dshd input to the PDM generation circuit 404. Such a PDM generation circuit 404 is also implemented by a known technique as is the case with the aforementioned each of the PDM generation circuits 206 and 308, and thus the detailed description thereof will be omitted. The PDM signal Pshd generated by the PDM generation circuit 404 is input to a filter circuit 406. The PDM generation circuit 404 also includes the ASIC 14*f*.

The filter circuit 406 is, for example, an RC low-pass filter circuit having one or more stages, and performs low-pass filter processing on the PDM signal Pshd input to the filter circuit 406. As a result, the PDM signal Pshd is converted into an analog signal, that is, an analog signal of a signal level according to the shading correction value is generated. This analog signal is input to the output current setting terminal RS of the laser driver 110 as the shading correction signal Vshd. Also, with regard to the filter circuit 406, the filter circuit 406 is not limited to the RC low-pass filter circuit, and may be an LC low-pass filter circuit, an active filter circuit, or the like, but the RC low-pass filter is suitable from the viewpoint of simplicity of circuit configuration and cost.

As described above, according to the first embodiment, the relative output difference between the first laser diode 102 and the second laser diode 104 is corrected by digital calculation. Therefore, for example, the variable resistor 146 such as that in the configuration illustrated in FIG. 4 is unnecessary, and the light source 14*c* can be reduced in size and cost accordingly. Moreover, since the relative output difference correction value (relative output difference correction table 306) for correcting the relative output difference is stored in the common EEPROM 14*e* together with the shading correction value (shading correction table 402) and the like, this greatly contributes to the miniaturization and cost reduction of the light source 14*c*.

Furthermore, according to the first embodiment, for example, the first reference signal Vref1 used for controlling the light emitting power of the first laser diode 102 is generated by the first reference signal generation circuit 200, and particularly generated by applying the low-pass filter processing by the filter circuit 208 to the PDM signal Pref1 output from the PDM generation circuit 206. Ripple caused by the operation of the PDM generation circuit 206 is superimposed on the first reference signal Vref1. However, it has been confirmed by experiments that the amplitude of this ripple is small, and more specifically, does not have a particular influence on the latent image, and thus the amplitude is small enough not to have a particular influence on the finally formed image.

In addition, the shading correction signal Vshd is used for controlling the light emitting power of the first laser diode 102. However, this shading correction signal Vshd is generated by the shading correction signal generation circuit 400, and particularly generated by applying the low-pass filter processing by the filter circuit 406 to the PDM signal Pshd output from the PDM generation circuit 404. In this shading correction signal Vshd as well, ripple caused by the operation of the PDM generation circuit 404 is superimposed. However, it has been confirmed by experiments that, the amplitude of this ripple is also small, and more specifically, the amplitude is small enough not to have a particular influence on the latent image and the finally formed image.

Then, the second reference signal Vref2 used for controlling the light emitting power of the second laser diode 104 is generated by the second reference signal generation circuit 300, and particularly generated by applying the low-pass filter processing by the filter circuit 310 to the PDM signal Pref2 output from the PDM generation circuit 308. In this second reference signal Vref2 as well, ripple caused by the operation of the PDM generation circuit 308 is superimposed. However, it has been confirmed by experiments that, the amplitude of this ripple also is small, and not have a particular influence on the latent image, and more specifically, the amplitude is small enough not to have a particular influence on the latent image and the finally formed image.

In addition, the shading correction signal Vshd is also used for controlling the light emitting power of the second laser diode 104, and as described above, ripple is superimposed on this shading correction signal Vshd as well. Meanwhile, it has been confirmed by experiments that the ripple superimposed on the shading correction signal Vshd also has no particular influence on the latent image and the finally formed image.

The laser driver 110 in the first embodiment is an example of the driver according to the present invention. Then, the first reference signal generation circuit 200 is an example of the first generator according to the present invention, and is particularly an example of the specific generator. That is, the first laser diode 102 is an example of the specific element according to the present invention. Then, the PDM generation circuit 206 of the first reference signal generation circuit 200 is an example of the second pulse generator according to the present invention, and the filter circuit 208 of the first reference signal generation circuit 200 is an example of the second filter according to the present invention. Moreover, the sub-scanning reference value stored in the first sub-scanning reference table 202, strictly speaking, the sub-scanning reference value corresponding to each position in the sub-scanning direction is an example of the predetermined value according to the present invention.

Furthermore, the second reference signal generation circuit 300 in the first embodiment is an example of the first generator according to the present invention, and is particularly an example of the correction parallel unit. Then, the relative output difference correction value stored in the relative output difference correction table 306 is an example of the first correction value according to the present invention. Moreover, the sub-scanning reference value stored in the second sub-scanning reference table 302 is an example of the predetermined value according to the present invention, similarly to the sub-scanning reference value stored in the first sub-scanning reference table 202 described above. Then, the multiplication circuit 304, the PDM generation circuit 308, and the filter circuit 310 of the second reference signal generation circuit 300 are examples of the first multiplier, the first pulse generator, and the first filter according to the present invention, respectively.

Additionally, the shading correction signal generation circuit 400 in the first embodiment is an example of the second generator according to the present invention. Then, the shading correction value stored in the shading correction table 402 is an example of the second correction value according to the present invention. Moreover, the PDM generation circuit 404 and filter circuit 406 of the shading correction signal generation circuit 400 are examples of the third pulse generator and third filter according to the present invention, respectively.

In the first embodiment, the sub-scanning reference value (Dref2) read from the second sub-scanning reference table 302 is the value corresponding to the next line of the sub-scanning reference value (Dref1) read from the first sub-scanning reference table 202, but is not limited to this. For example, the sub-scanning reference value (Dref2) read from the second sub-scanning reference table 302 and the sub-scanning reference value (Dref1) read from the first sub-scanning reference table 202 may be set to values corresponding to the same line, that is, may have the same value.

Moreover, the multiplication circuit 204 and the PDM generation circuit 206 of the first reference signal generation circuit 200 includes one element (integrated circuit) called ASIC 14*f*, but may include, for example, elements that are separate from each other. Similarly, the multiplication circuit 304 and the PDM generation circuit 308 of the second reference signal generation circuit 300 include the ASIC 14*f*, but may include elements that are separate from each other. Furthermore, the PDM generation circuit 404 of the shading correction signal generation circuit 400 may include an element separate from the ASIC 14*f*. However, since these circuits 204, 206, 304, 308 and 404 include the ASIC 14*f*, the exposure device 14*b* including the light source 14*c* can be miniaturized and the cost can be reduced.

Then, the first sub-scanning reference table 202 of the first reference signal generation circuit 200, the second sub-scanning reference table 302 and the relative output difference correction table 306 of the second reference signal generation circuit 300, and the shading correction table 402 of the shading correction signal generation circuit 400 are stored in one storage called EEPROM 14*e*, but is not limited to this. That is, some or all of these tables 202, 302, 306 and 402 may be stored in storages that are separate from each other. Moreover, as the storage, a non-volatile semiconductor memory other than the EEPROM 14*a* such as a flash memory may be adopted.

Furthermore, even if a part or all of each of tables 202, 302, 306 and 402 may be stored in a storage such as a RAM or a register (not illustrated) in the ASIC 14*f* when the power of the multifunction peripheral 10 is turned on, for example. Then, the values in the respective tables 202, 302, 306 or 402 may be read from the respective tables 202, 302, 306 or 402 stored in the storage in the ASIC 14*f*.

Additionally, the first reference signal generation circuit 200 may be configured in such a manner that the first reference signal Vref1 generated by the first reference signal generation circuit 200 is directly input to the first output control terminal Vcnt1 of the laser driver 110 without going through the voltage dividing circuit 130. According to this configuration, the voltage dividing circuit 130 becomes unnecessary. Similarly, the second reference signal generation circuit 300 may be configured in such a manner that the second reference signal Vref2 generated by the second reference signal generation circuit 300 is directly input to the second output control terminal Vcnt2 of the laser driver 110 without going through the voltage dividing circuit 140. According to this configuration, the voltage dividing circuit 140 becomes unnecessary.

Second Embodiment

Next, a second embodiment of the present invention will be described.

Figure 8:
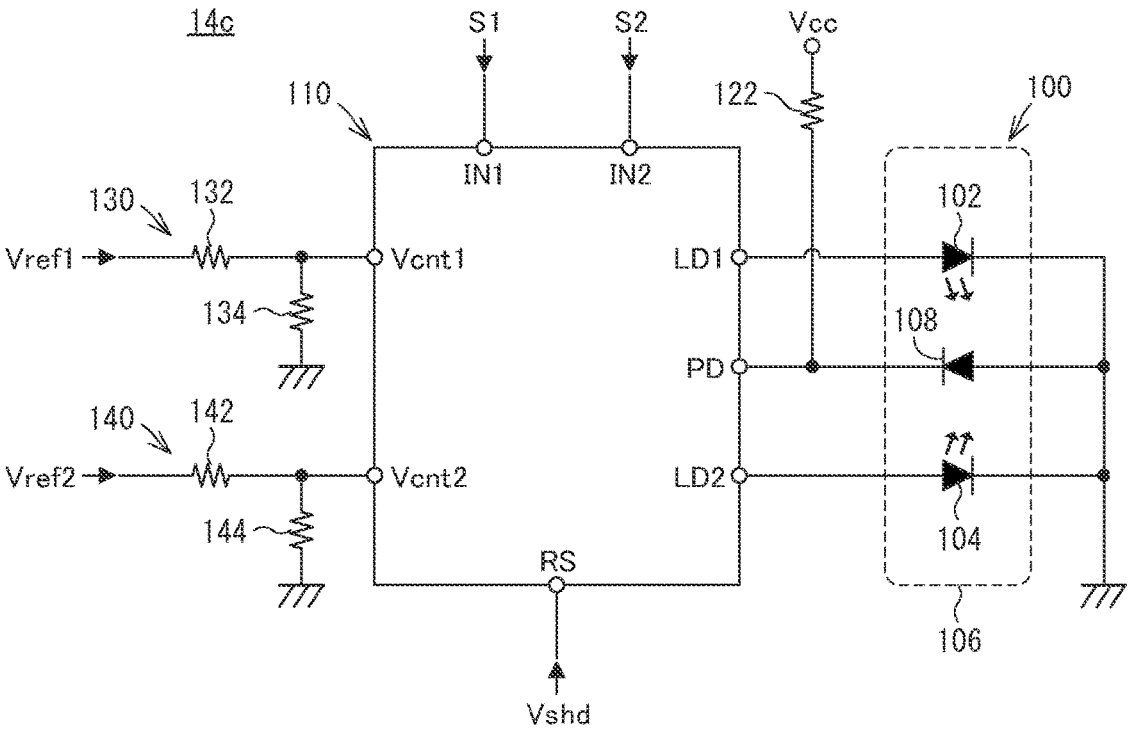
FIG. 8 is a diagram illustrating an electrical configuration of a light source in a second embodiment of the present invention.

In the second embodiment, the light source 14*c* is configured as illustrated in FIG. 8. According to the configuration illustrated in FIG. 8, a fixed resistor 122 is provided as an alternative to the variable resistor 120 in the first embodiment (FIG. 3). That is, the sensitivity of the photodiode 108 is fixed.

Figure 9:
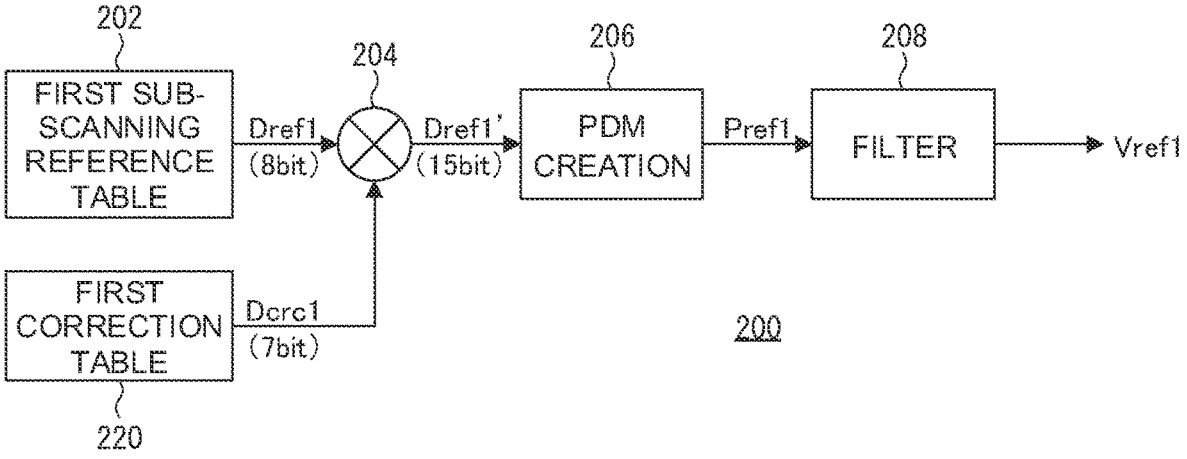
FIG. 9 is a diagram illustrating a configuration of a first reference signal generation circuit in the second embodiment.

Then, the first reference signal generation circuit 200 is configured as illustrated in FIG. 9. According to the configuration illustrated in FIG. 9, first correction data Dcrc1 read from a first correction table 220 is input to the multiplication circuit 204 as an alternative to the dummy data Ddum in the first embodiment (FIG. 5). That is, the first correction table 220 is provided.

Figure 10:
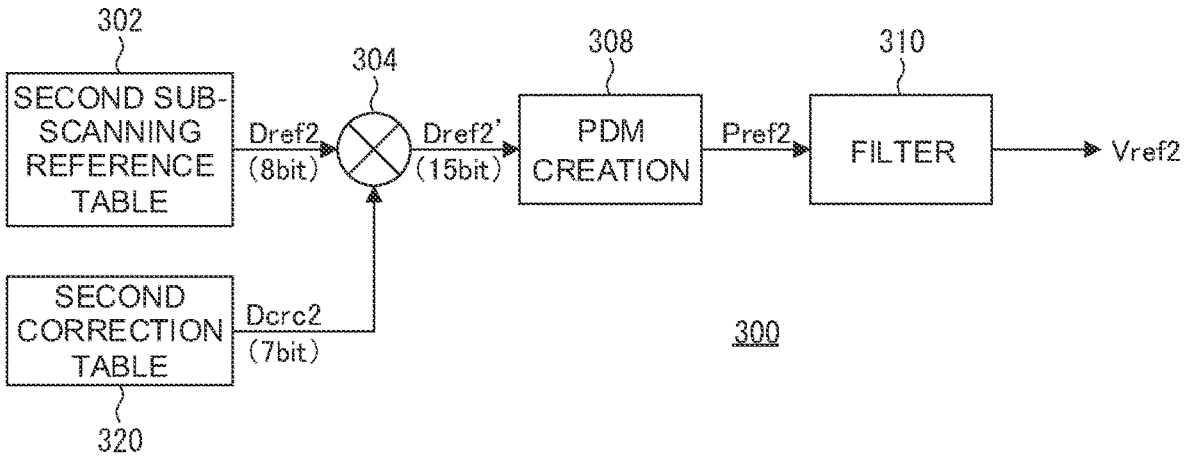
FIG. 10 is a diagram illustrating a configuration of a second reference signal generation circuit in the second embodiment.

In addition, the second reference signal generation circuit 300 is configured as illustrated in FIG. 10. According to the configuration illustrated in FIG. 10, a second correction table 320 is provided as an alternative to the relative output difference correction table 306 in the first embodiment (FIG. 6). Then, second correction data Dcrc2 read from the second correction table 320 is input to the multiplication circuit 304.

The other configurations in the second embodiment are the same as the configurations in the first embodiment. Therefore, the parts in the second embodiment same as the parts in the first embodiment are designated by the same reference numerals as the parts in the first embodiment, and the detailed description thereof will be omitted.

According to the second embodiment, the sensitivity of the photodiode 108 is fixed as described above. Then, the first reference signal generation circuit 200 causes the first laser diode 102 to emit light with a desired power, and generates a first reference signal Vref1 capable of correcting the relative output difference between the first laser diode 102 and the second laser diode 104. In addition, the second reference signal generation circuit 300 causes the second laser diode 104 to emit light with a desired power, and generates a second reference signal Vref2 capable of correcting the relative output difference between the second laser diode 104 and the first laser diode 102.

Therefore, for the first reference signal generation circuit 200 illustrated in FIG. 9, the first correction value is stored in the first correction table 220. This first correction value is obtained by an experiment in advance. Specifically, in the configuration illustrated in FIG. 8, the aforementioned test image signal is input to the first image signal input terminal IN1 of the laser driver 110 as the first image signal S1. On the other hand, the second image signal S2 is not input to the second image signal input terminal IN2. In addition, the signal level of the second reference signal Vref2 is set to 0 V. Furthermore, the signal level of the shading correction signal Vshd is set to 0 V. In this state, the signal level of the first reference signal Vref1 is adjusted in such a manner that the signal level of the monitor signal input from the photodiode 108 to the monitor terminal PD becomes the aforementioned monitor reference level. The value corresponding to the level obtained by subtracting the aforementioned test level from the signal level of the first reference signal Vref1 at this time is defined as the first correction value. This first correction value is stored in the first correction table 220, and more specifically, is stored in the EEPROM 14*e* in a state of being collected in the first correction table 220.

The first correction value stored in the first correction table 220 is read from the first correction table 220 in synchronization with the reading timing of the sub-scanning reference value from the first sub-scanning reference table 202. The first correction value read from the first correction table 220 is input to the multiplication circuit 204 as the first correction data Dcrc1 described above. The first correction data Dcrc1 is a 7-bit digital signal. After that, the first reference signal Vref1 is generated in the same manner as in the first embodiment.

Then, for the second reference signal generation circuit 300 illustrated in FIG. 10, the second correction value is stored in the second correction table 320. This second correction value is also obtained by an experiment in advance. Specifically, in the configuration illustrated in FIG. 8, the aforementioned test image signal is input to the second image signal input terminal IN2 of the laser driver 110 as the second image signal S2. On the other hand, the first image signal S1 is not input to the first image signal input terminal IN1. In addition, the signal level of the first reference signal Vref1 is set to 0 V. Furthermore, the signal level of the shading correction signal Vshd is set to 0 V. In this state, the signal level of the second reference signal Vref2 is adjusted in such a manner that the signal level of the monitor signal input from the photodiode 108 to the monitor terminal PD becomes the aforementioned monitor reference level. The value corresponding to the level obtained by subtracting the aforementioned test level from the signal level of the second reference signal Vref2 at this time is defined as the second correction value. This second correction value is stored in the second correction table 320, and more specifically, is stored in the EEPROM 14*e* in a state of being collected in the second correction table 320.

The second correction value stored in the second correction table 320 is read from the second correction table 320 in synchronization with the reading timing of the sub-scanning reference value from the second sub-scanning reference table 302. The second correction value read from the second correction table 320 is input to the multiplication circuit 304 as the second correction data Dcrc2 described above. The second correction data Dcrc2 is also a 7-bit digital signal. After that, the second reference signal Vref2 is generated in the same manner as in the first embodiment.

In the second embodiment having such a configuration as well, the relative output difference between the first laser diode 102 and the second laser diode 104 is corrected. That is, the relative output difference is corrected by digital calculation by both the first reference signal generation circuit 200 and the second reference signal generation circuit 300.

The first reference signal generation circuit 200 and the second reference signal generation circuit 300 in the second embodiment are both examples of the first generator according to the present invention, and are particularly examples of the correction parallel unit.

Third Embodiment

Next, a third embodiment of the present invention will be described.

Figure 11:
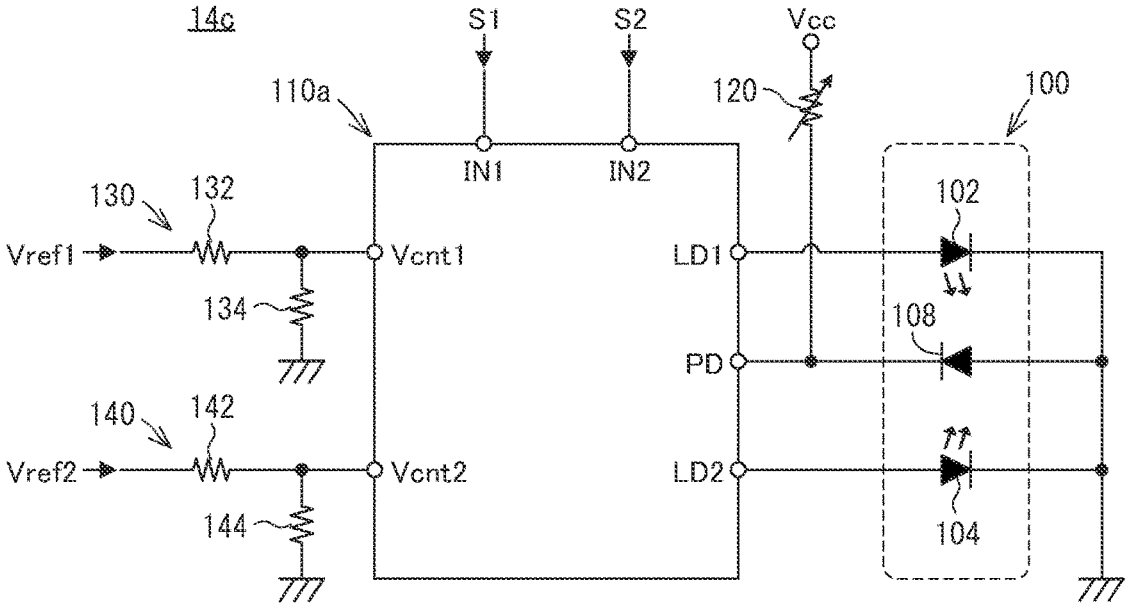
FIG. 11 is a diagram illustrating an electrical configuration of a light source in a third embodiment of the present invention.

In the third embodiment, the light source 14*c* is configured as illustrated in FIG. 11. According to the configuration illustrated in FIG. 11, a laser driver 110*a* not including the output current setting terminal RS is provided as an alternative to the laser driver 110 in the first embodiment (FIG. 3), that is, the laser driver 110 including the output current setting terminal RS. That is, in the third embodiment, there is no output current setting terminal RS that receives the input of the shading correction signal Vshd.

Then, the shading correction value is included in the first reference signal Vref1, and strictly speaking, a component according to the shading correction value is included. In addition, the shading correction value is included in the second reference signal Vref2 as well, and strictly speaking, a component according to the shading correction value is included.

Figure 12:
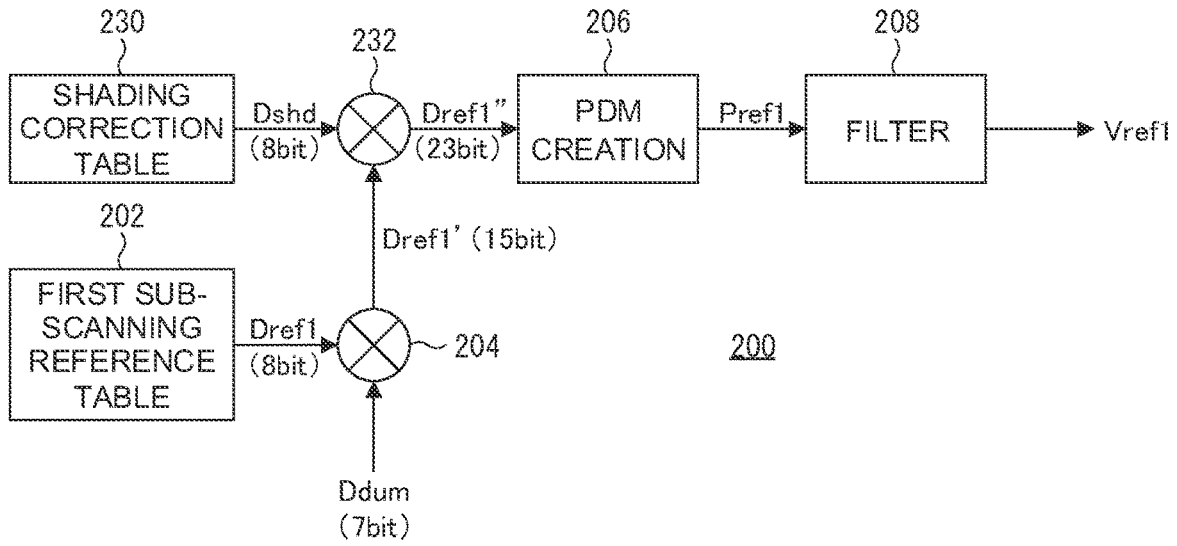
FIG. 12 is a diagram illustrating a configuration of a first reference signal generation circuit in the third embodiment.

Therefore, the first reference signal generation circuit 200 is configured as illustrated in FIG. 12. According to the configuration illustrated in FIG. 12, in addition to the configuration in the first embodiment (FIG. 5), a shading correction table 230 and a multiplication circuit 232 are provided.

The shading correction table 230 is the same element as the shading correction table 402 in the first embodiment (FIG. 7). That is, the shading correction value is stored in the shading correction table 230. Strictly speaking, the shading correction value is stored in the EEPROM 14*e* in a state of being collected in the shading correction table 230.

The shading correction value stored in the shading correction table 230 (EEPROM 14*e*) is sequentially read from the shading correction table 230 in accordance with the irradiation position of the laser beam with respect to the surface of the photoconductor drum 14*a* in the main scanning direction. The shading correction value read from this shading correction table 230, that is, the shading correction data Dshd, is input to the multiplication circuit 232. The shading correction data Dshd is, for example, an 8-bit digital signal.

In addition to the shading correction data Dshd, the first sub-scanning reference data Dref1' after the multiplication by the multiplication circuit 204 is input to the multiplication circuit 232. The multiplication circuit 232 multiplies these shading correction data Dshd and the first sub-scanning reference data Dref1' together to generate first reference data Dref1". This first reference data Dref1", that is, the first reference data Dref1" including the shading correction value is input to the PDM generation circuit 206. This first reference data Dref1" is a 23-bit (=8-bit+15-bit) digital signal. After that, the first reference signal Vref1 is generated in the same manner as in the first embodiment. The multiplication circuit 232 also includes the ASIC 14*f*.

Figure 13:
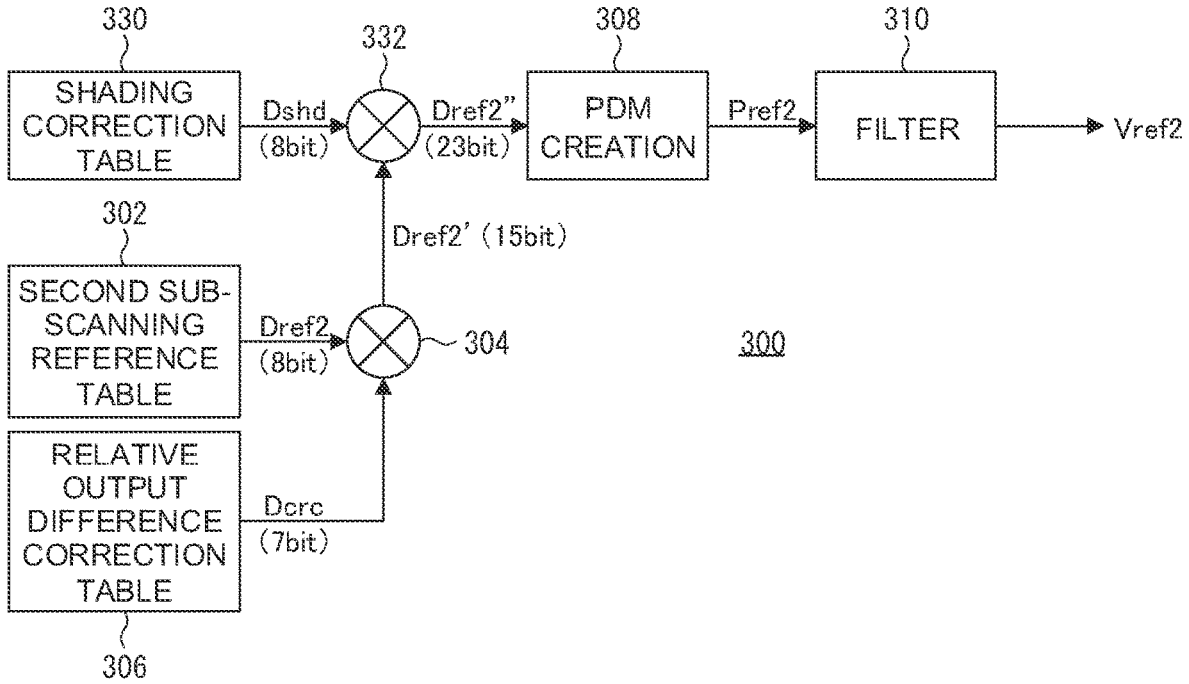
FIG. 13 is a diagram illustrating a configuration of a second reference signal generation circuit in the third embodiment.

In addition, the second reference signal generation circuit 300 is configured as illustrated in FIG. 13. According to the configuration illustrated in FIG. 13, in addition to the configuration in the first embodiment (FIG. 6), a shading correction table 330 and a multiplication circuit 332 are provided.

The shading correction table 330 is the same element as the shading correction table 402 in the first embodiment (FIG. 7), in other words, the same element as the shading correction table 230 in FIG. 12. The shading correction value is stored in the shading correction table 330. Strictly speaking, the shading correction value is stored in the EEPROM 14*e* in a state of being collected in the shading correction table 330 as well.

The shading correction value stored in the shading correction table 330 (EEPROM 14*e*) is sequentially read from the shading correction table 330 in accordance with the irradiation position of the laser beam with respect to the surface of the photoconductor drum 14*a* in the main scanning direction. The shading correction value read from this shading correction table 330, that is, the shading correction data Dshd, is input to the multiplication circuit 332. The shading correction data Dshd is, for example, an 8-bit digital signal.

In addition to the shading correction data Dshd, the second sub-scanning reference data Dref2' after the multiplication by the multiplication circuit 304 is input to the multiplication circuit 332. The multiplication circuit 332 multiplies these shading correction data Dshd and the second sub-scanning reference data Dref2' together to generate second reference data Dref2". This second reference data Dref2", that is, the second reference data Dref2" including the shading correction value is input to the PDM generation circuit 308. This second reference data Dref2" is a 23-bit (=8-bit+15-bit) digital signal. After that, the second reference signal Vref2 is generated in the same manner as in the first embodiment. The multiplication circuit 332 also includes the ASIC 14*f*.

In the third embodiment, the shading correction signal generation circuit 400 (FIG. 7) such as that in the first embodiment is not provided. The other configurations in the third embodiment are the same as the configurations in the first embodiment. Therefore, the parts in the third embodiment same as the parts in the first embodiment are designated by the same reference numerals as the parts in the first embodiment, and the detailed description thereof will be omitted.

As described above, in the third embodiment, the laser driver 110*a* not including the output current setting terminal RS is adopted. Therefore, the shading correction value is included in each of the first reference signal Vref1 and the second reference signal Vref2. In the third embodiment having such a configuration as well, the non-uniform shading in the main scanning direction is corrected, the non-uniformity in the sub-scanning direction is corrected, and further, the relative output difference between the first laser diode 102 and the second laser diode 104 is corrected.

The multiplication circuit 232, the PDM generation circuit 206, and the filter circuit 208 of the first reference signal generation circuit 200 in the third embodiment are examples of the second multiplier, the fourth pulse generator, and the fourth filter according to the present invention, respectively.

Moreover, in the third embodiment as well, the same technique as in the second embodiment may be applied. That is, in the third embodiment as well, digital calculation for correcting the relative output difference may be performed by both the first reference signal generation circuit 200 and the second reference signal generation circuit 300.

Fourth Embodiment

Next, a fourth embodiment of the present invention will be described.

The fourth embodiment is an improved example of the third embodiment, and in particular, is an improved example of the first reference signal generation circuit 200 and the second reference signal generation circuit 300.

Specifically, in the configuration of the first reference signal generation circuit 200 (FIG. 12) in the third embodiment, the ripple caused by the operation of the PDM generation circuit 206 may affect the latent image and thus may affect the finally formed image. Similarly, even in the configuration of the second reference signal generation circuit 300 (FIG. 13) in the third embodiment, the ripple caused by the operation of the PDM generation circuit 308 may affect the latent image and the finally formed image.

More specifically, in the first reference signal generation circuit 200 (FIG. 12) in the third embodiment, the first reference data Dref1" with a data length of 23 bits is input to the PDM generation circuit 206. On the other hand, for example, in the first reference signal generation circuit 200 (FIG. 5) in the first embodiment, the first sub-scanning reference data Dref1' with a data length of 15 bits is input to the PDM generation circuit 206. Here, the PDM generation circuit 206 has a resolution corresponding to the data length of the data input to the PDM generation circuit 206, in other words, has such a configuration. That is, the PDM generation circuit 206 in the third embodiment (FIG. 12) has a higher resolution than the resolution of the PDM generation circuit 206 in the first embodiment (FIG. 5).

Meanwhile, the higher the resolution of the PDM generation circuit 206, in particular, the smaller the number of pulses per unit time of the PDM signal Pref1 generated by the PDM generation circuit 206 (when such data is input to the PDM generation circuit 206), the pulse width of the PDM signal Pref1 becomes large. In order to faithfully convert the PDM signal Pref1 having such a large pulse width into an analog signal by the filter circuit 208, a filter circuit 208 having a large time constant is required.

However, the time constant of the filter circuit 208 of the first reference signal generation circuit 200 (FIG. 12) in the third embodiment must match the change in the shading correction value. Thus, for example, the time constant of the filter circuit 208 must be small as the time constant of the filter circuit 406 of the shading correction signal generation circuit 400 in the first embodiment. That is, the time constant of the filter circuit 208 is smaller than the time constant of the filter circuit 208 of the first reference signal generation circuit 200 (FIG. 5) in the first embodiment. Therefore, in the first reference signal generation circuit 200 (FIG. 12) in the third embodiment, the PDM signal Pref1 generated by the PDM generation circuit 206 may not be faithfully converted into an analog signal by the filter circuit 208. In such a case, a ripple having a relatively large amplitude occurs, and this ripple may affect the latent image and the finally formed image.

This also applies to the second reference signal generation circuit 300 (FIG. 13) in the third embodiment.

Figure 14:
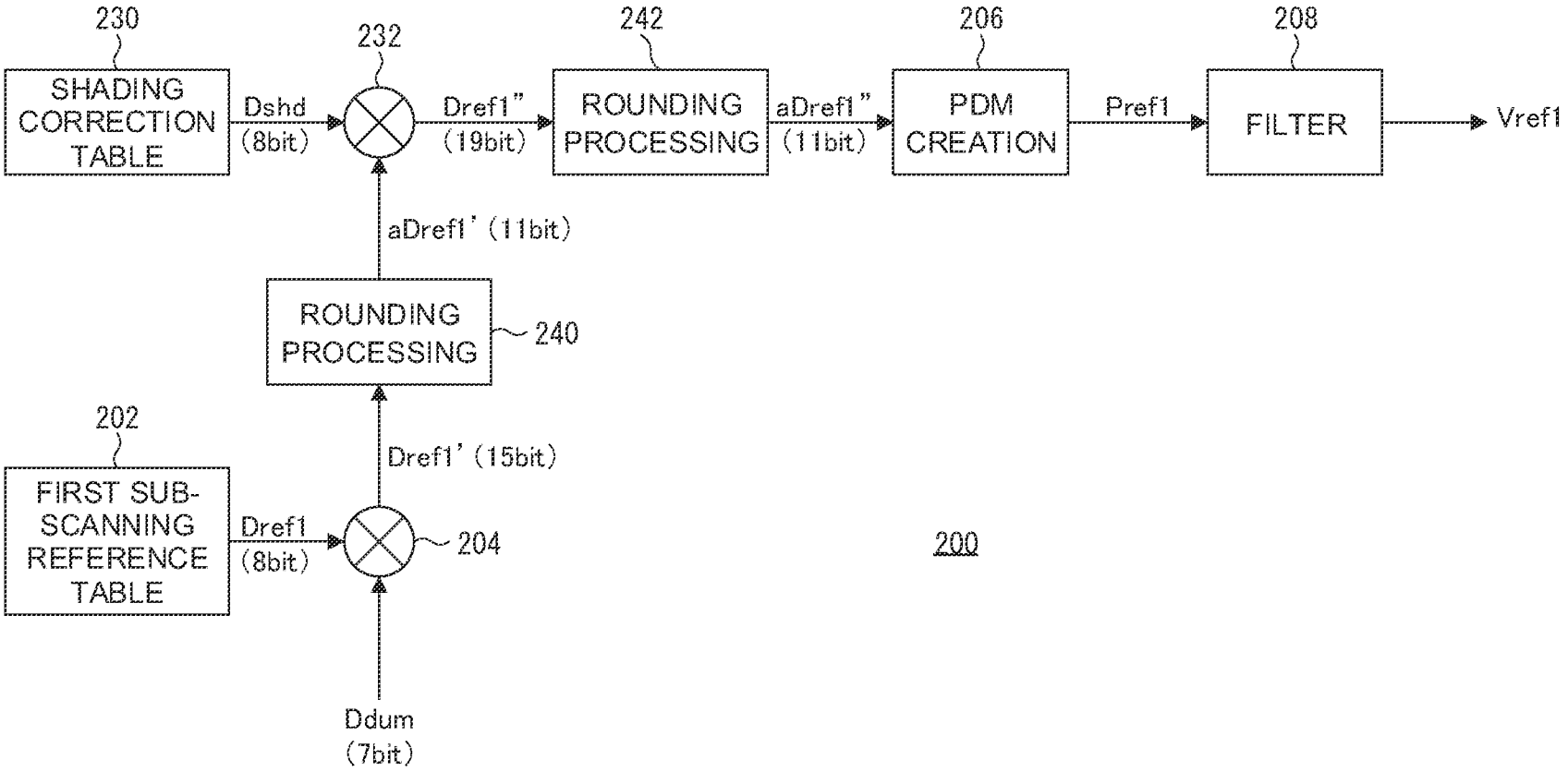
FIG. 14 is a diagram illustrating a configuration of a first reference signal generation circuit in a fourth embodiment of the present invention.

Accordingly, in the fourth embodiment, the first reference signal generation circuit 200 is configured as illustrated in FIG. 14. According to the configuration illustrated in FIG. 14, in addition to the first reference signal generation circuit 200 (FIG. 12) in the third embodiment, two rounding processing circuits 240 and 242 are provided. These rounding processing circuits 240 and 242 also include the ASIC 14*f*.

One rounding processing circuit 240 is provided between the two multiplication circuits 204 and 232. The first sub-scanning reference data Dref1' after multiplication by the multiplication circuit 204, that is, the first sub-scanning reference data Dref1' with a data length of 15 bits is input to the rounding processing circuit 240. The rounding processing circuit 240 performs known rounding processing on the first sub-scanning reference data Dref1' input to the rounding processing circuit 240, for example, performs half-rounding up processing with a 4-bit rounding width, thereby shortening the data length of the first sub-scanning reference data Dref1' from 15 bits to 11 bits. That is, in a case where the 12th bit from the most significant bit of the first sub-scanning reference data Dref1' is "1", the rounding processing circuit 240 adds "1" to the 11th bit from the most significant bit, and then truncates the 12th bit or less (that is, the lower 4 bits) from the most significant bit. On the other hand, in a case where the 12th bit from the most significant bit of the first sub-scanning reference data Dref1' is "0", the rounding processing circuit 240 truncates the 12th bit or less from the most significant bit as it is. First sub-scanning reference data aDref1' after the rounding processing by the rounding processing circuit 240 is input to the multiplication circuit 232.

The multiplication circuit 232 multiplies the shading correction data Dshd and the first sub-scanning reference data aDref1' after the rounding processing input to the multiplication circuit 232 together to generate the first reference data Dref1". This first reference data Dref1" is input to the other rounding processing circuit 242. The data length of the first reference data Dref1" is 19-bit (=8-bit+11-bit).

The rounding processing circuit 242 performs rounding processing on the first reference data Dref1" input to the rounding processing circuit 242, for example, performs half-rounding up processing with an 8-bit rounding width, thereby shortening the data length of the first reference data Dref1" from 19 bits to 11 bits. That is, in a case where the 12th bit from the most significant bit of the first reference data Dref1" is "1", the rounding processing circuit 242 adds "1" to the 11th bit from the most significant bit, and then truncates the 12th bit or less (that is, the lower 8 bits) from the most significant bit. On the other hand, in a case where the 12th bit from the most significant bit of the first reference data Dref1" is "0", the rounding processing circuit 242 truncates the 12th bit or less from the most significant bit as it is. First reference data aDref1" after the rounding processing by the rounding processing circuit 242 is input to the PDM generation circuit 206.

By inputting the first reference data aDref1" with the shortened data length to the PDM generation circuit 206 in this way, the resolution of the PDM generation circuit 206 can be reduced. As a result, the pulse interval of the PDM signal Pref1 is narrowed, and even the filter circuit 208 having a small time constant can faithfully convert the PDM signal Pref1 into an analog signal. As a result, the amplitude of the ripple described above is suppressed, and the influence of the ripple on the latent image and the finally formed image is surely suppressed (to the extent of little to no).

Figure 15:
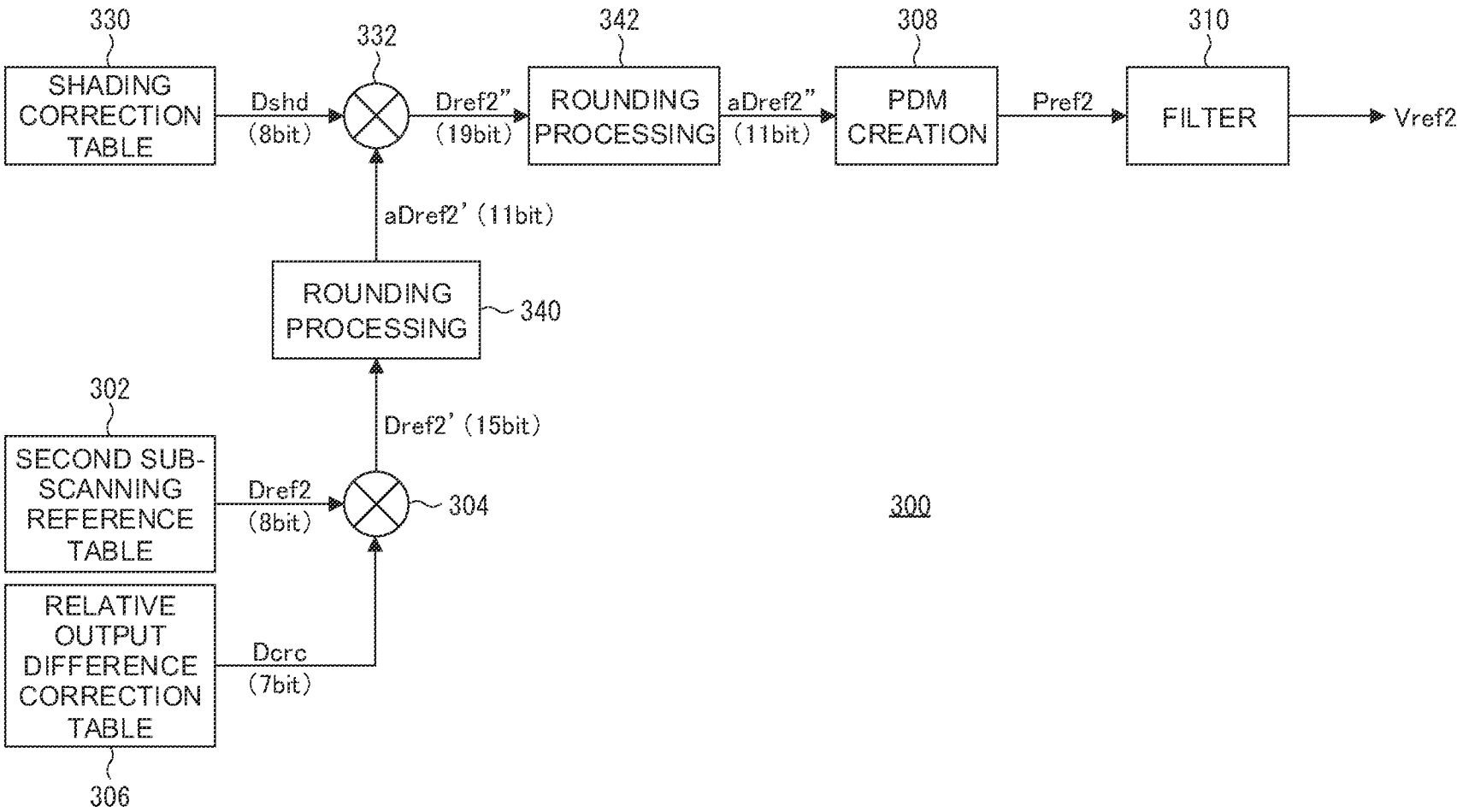
FIG. 15 is a diagram illustrating a configuration of a second reference signal generation circuit in the fourth embodiment.

Similarly, the second reference signal generation circuit 300 is configured as illustrated in FIG. 15. According to the configuration illustrated in FIG. 15, in addition to the second reference signal generation circuit 300 (FIG. 13) in the third embodiment, two rounding processing circuits 340 and 342 are provided.

One rounding processing circuit 340 is provided between the two multiplication circuits 304 and 332. The second sub-scanning reference data Dref2' after multiplication by the multiplication circuit 304, that is, the second sub-scanning reference data Dref2' with a data length of 15 bits is input to the rounding processing circuit 340. The rounding processing circuit 340 performs known rounding processing on the second sub-scanning reference data Dref2' input to the rounding processing circuit 340, more specifically, performs half-rounding up processing similar to the half-rounding up processing of the rounding processing circuit 240 of the second reference signal generation circuit 300, thereby shortening the data length of the second sub-scanning reference data Dref2' from 15 bits to 11 bits. Second sub-scanning reference data aDref2' after the rounding processing by the rounding processing circuit 340 is input to the multiplication circuit 332.

The multiplication circuit 332 multiplies the shading correction data Dshd and the second sub-scanning reference data aDref2' after the rounding processing input to the multiplication circuit 332 together to generate the second reference data Dref2". This second reference data Dref2" is input to the other rounding processing circuit 342. The data length of the second reference data Dref2" is 19-bit (=8-bit+11-bit).

The rounding processing circuit 342 performs known rounding processing on the second reference data Dref2" input to the rounding processing circuit 342, more specifically, performs half-rounding up processing similar to the half-rounding up processing of the rounding processing circuit 242 of the second reference signal generation circuit 300, thereby shortening the data length of the second reference data Dref2" from 19 bits to 11 bits. Second reference data aDref2" after the rounding processing by the rounding processing circuit 342 is input to the PDM generation circuit 308.

By inputting the second reference data aDref2" with the shortened data length to the PDM generation circuit 308 in this way, the resolution of the PDM generation circuit 308 can be reduced. As a result, the influence of the ripple on the latent image and the finally formed image is surely suppressed.

In particular, the two rounding processing circuits 240 and 242 in the first reference signal generation circuit 200 (FIG. 14) in the fourth embodiment are examples of the first rounding processor according to the present invention. These two rounding processing circuits 240 and 242 have rounding widths of 4 bits and 8 bits, respectively, but the value (number of bits) of these rounding widths is not particularly limited. However, it is important that each rounding width is set to a value that does not affect the first reference signal Vref1 that is finally generated by the first reference signal generation circuit 200, for example, a value that eliminates noise components. Moreover, only one of the rounding processing circuits 240 or 242 may be provided, but in order to reduce the influence of ripple and obtain the desired first reference signal Vref1, it is desirable that two rounding processing circuits 240 and 242 be provided as in the fourth embodiment (that is, the rounding processing is performed in a distributed manner). Furthermore, while the rounding processing circuits 240 and 242 include the ASIC 14*f*, they may include elements that are separate from each other. Additionally, while the half-rounding up processing is adopted as the rounding processing by each of the rounding processing circuits 240 and 242, truncation processing may be adopted in which the lower bits corresponding to the rounding width are simply truncated.

The two rounding processing circuits 340 and 342 in the second reference signal generation circuit 300 (FIG. 15) are examples of the second rounding processor according to the present invention. Similarly to the two rounding processing circuits 240 and 242 in the first reference signal generation circuit 200, the rounding widths of these two rounding processing circuits 340 and 342 are not limited, and either one may be provided, and may further include elements that are separate from each other. Additionally, while the half-rounding up processing is adopted as the rounding processing by each of the rounding processing circuits 340 and 342, truncation processing may be adopted as an alternative to the half-rounding up processing.

In such fourth embodiment as well, the same technique as in the second embodiment may be applied. That is, in the fourth embodiment as well, digital calculation for correcting the relative output difference may be performed by both the first reference signal generation circuit 200 and the second reference signal generation circuit 300.

Fifth Embodiment

Next, a fifth embodiment of the present invention will be described.

The fifth embodiment is a further improved example of the fourth embodiment, and in particular, is a further improved example of the first reference signal generation circuit 200 and the second reference signal generation circuit 300.

Figure 16:
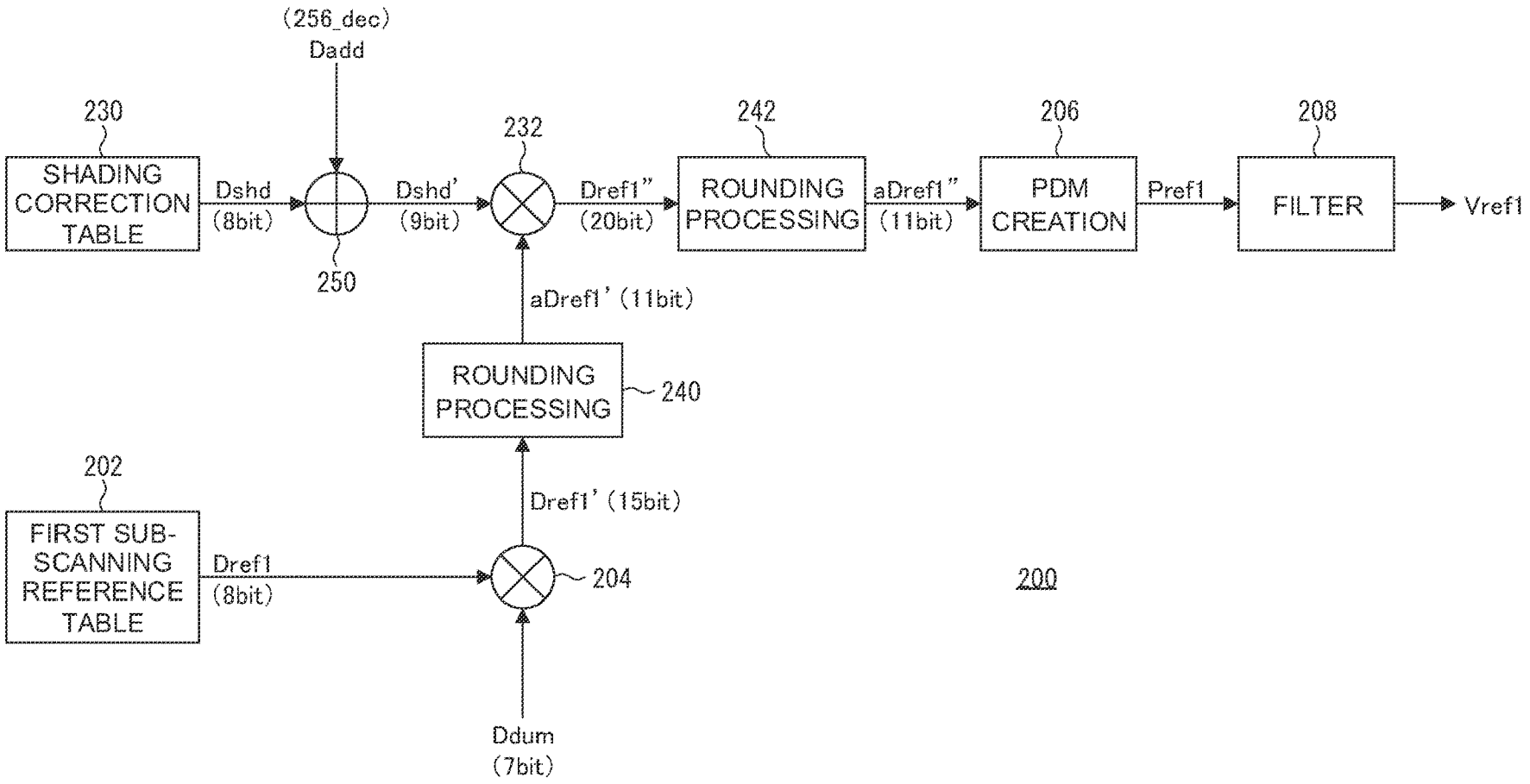
FIG. 16 is a diagram illustrating a configuration of a first reference signal generation circuit in a fifth embodiment of the present invention.

Specifically, in the fifth embodiment, the first reference signal generation circuit 200 is configured as illustrated in FIG. 16. According to the configuration illustrated in FIG. 16, in addition to the first reference signal generation circuit 200 (FIG. 14) in the fourth embodiment, an addition circuit 250 is provided as a first adder. This addition circuit 250 also includes the ASIC 14*f*.

More specifically, the addition circuit 250 is provided between the shading correction table 230 and the multiplication circuit 232. Then, the shading correction data Dshd read from the shading correction table 230 is input to the addition circuit 250. In addition, addition data Dadd representing a value "255" in decimal is input to the addition circuit 250. The addition data Dadd is generated by the ASIC 14*f*. In other words, a dummy generation circuit (not illustrated) for generating the addition data Dadd includes the ASIC 14*f*.

The addition circuit 250 adds the shading correction data Dshd and the addition data Dadd input to the addition circuit 250, so to speak, adds one bit to the shading correction data Dshd. Since such addition circuit 250 is implemented by a known technique, the detailed description thereof will be omitted. The shading correction data Dshd' after the addition by the addition circuit 250, that is, the shading correction data Dshd' with a data length of 9 bits is input to the multiplication circuit 232. After that, the first reference signal Vref1 is generated in the same manner as in the fourth embodiment. However, the rounding processing circuit 242 in the fifth embodiment performs rounding processing with a rounding width of 9 bits.

Figure 17:
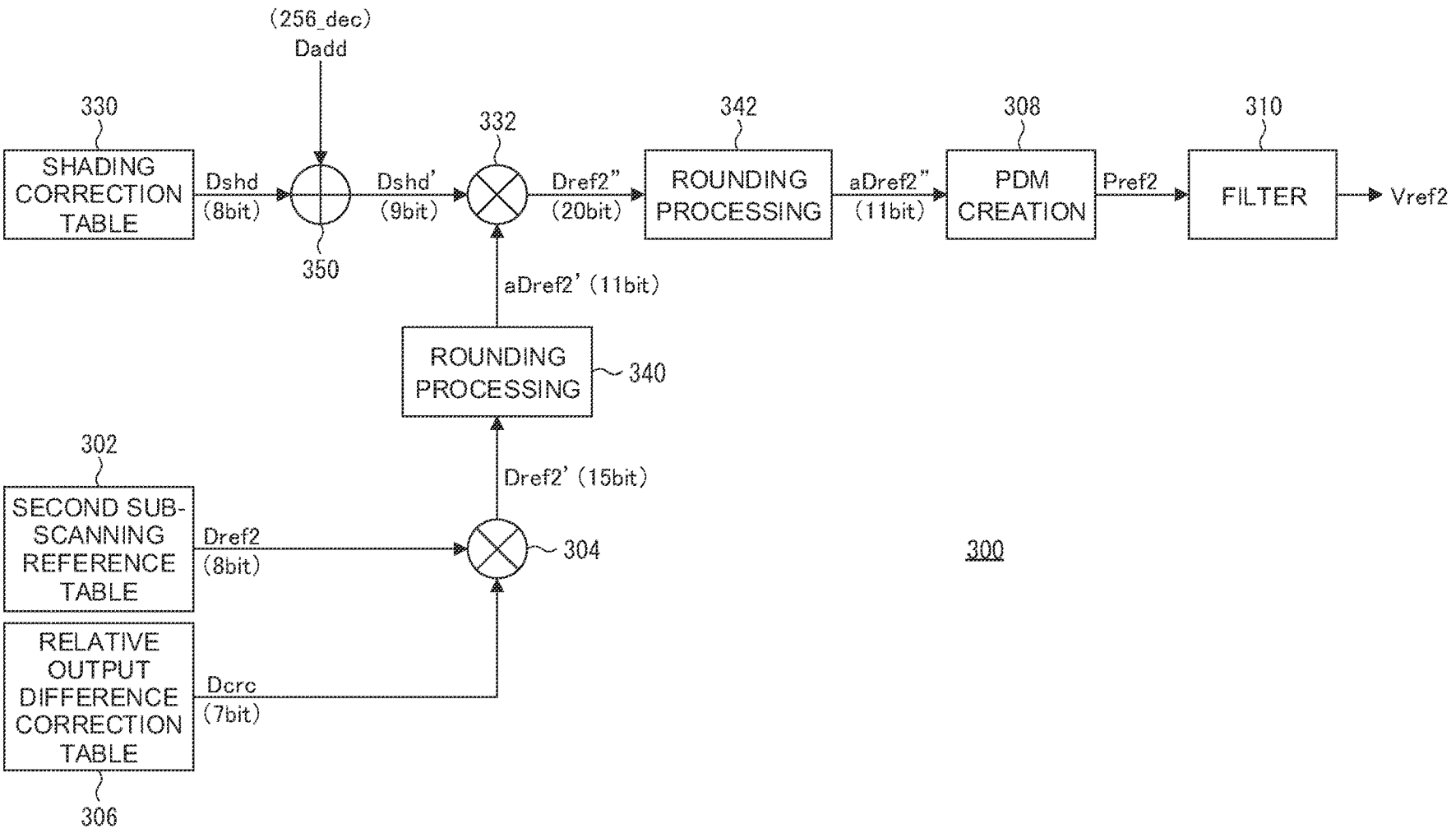
FIG. 17 is a diagram illustrating a configuration of a second reference signal generation circuit in the fifth embodiment.

Similarly, in the second reference signal generation circuit 300 in the fifth embodiment is configured as illustrated in FIG. 17. According to the configuration illustrated in FIG. 17, in addition to the second reference signal generation circuit 300 (FIG. 15) in the fourth embodiment, an addition circuit 350 is provided as a second adder. This addition circuit 350 also includes the ASIC 14*f*.

More specifically, the addition circuit 350 is provided between the shading correction table 330 and the multiplication circuit 332. Then, the shading correction data Dshd read from the shading correction table 330 is input to the addition circuit 350. In addition, the aforementioned addition data Dadd is input to the addition circuit 350.

The addition circuit 350 adds the shading correction data Dshd and the addition data Dadd input to the addition circuit 350. The shading correction data Dshd' after the addition by the addition circuit 350, that is, the shading correction data Dshd' with a data length of 9 bits is input to the multiplication circuit 332. After that, the second reference signal Vref2 is generated in the same manner as in the fourth embodiment. However, the rounding processing circuit 342 in the fifth embodiment performs rounding processing with a rounding width of 9 bits.

According to the fifth embodiment having such a configuration, the shading correction data Dshd is added with one bit, and thus the resolution of the shading correction is increased, which is twice the resolution of the shading correction of the fourth embodiment, for example. As a result, more accurate shading correction is performed as compared with the fourth embodiment.

The value of the addition data Dadd is not limited to the decimal number "255", that is, the value for one bit. However, the larger the value of the addition data Dadd, the smaller the width (range) in which shading correction can be performed. Therefore, it is important that the value of the addition data Dadd is determined in consideration of this.

In addition, in the fifth embodiment as well, the same technique as in the second embodiment may be applied. That is, in the fifth embodiment as well, digital calculation for correcting the relative output difference may be performed by both the first reference signal generation circuit 200 and the second reference signal generation circuit 300.

Furthermore, in the first to third embodiments as well, the same technique as in the fifth embodiment may be applied. That is, in the first to third embodiments as well, the same addition circuit as in the fifth embodiment may be provided in such a manner that more accurate shading correction can be performed.

Other Application Example

Each of the above examples is a specific example of the present invention and does not limit the technical scope of the present invention. The present invention is applicable to aspects other than these examples.

For example, as the multi-beam light source 100, the one having two laser diodes 102 and 104 has been exemplified, but the present invention is not limited to this. That is, the present invention can also be applied to a multi-beam light source having three or more laser diodes.

In addition, the present invention can also be applied to a multi-beam light source having a light emitting element other than a laser diode.

Moreover, the present invention can be applied not only to the multifunction peripheral 10 but also to an image forming apparatus other than the multifunction peripheral 10 such as a copier and a printer.

Furthermore, the present invention can be provided as a multi-beam light source driving device, or can be provided as a multi-beam light source driving method.

What is claimed is:

1. A multi-beam light source driving device for driving a multi-beam light source including a plurality of light emitting elements, the multi-beam light source driving device comprising:

a driver that controls a light emitting power of a corresponding light emitting element on a basis of a signal level of each of a plurality of first control signals, the plurality of first control signals being a plurality of analog signals individually corresponding to the plurality of light emitting elements and being input to the driver; and a plurality of first generators that individually generate the plurality of first control signals, wherein some of the plurality of first generators are correction parallel units that generate the first control signals including a first correction component for correcting a variation in the light emitting power due to an individual difference of each of the plurality of light emitting elements, the correction parallel units including:

a first multiplier that digitally multiplies a predetermined value for setting the signal level to a predetermined level and a first correction value for exhibiting the first correction component together;

a first pulse generator that generates a first pulse signal that is a pulse density modulation signal according to a multiplication result by the first multiplier; and a first filter that generates the first control signal including the first correction component by applying low-pass filter processing to the first pulse signal, wherein a specific generator corresponding to a specific element that is a specific light emitting element among the plurality of first generators generates the first control signal of the predetermined level, and each of the first generators other than the specific generator among the plurality of first generators generates the first control signal including the first correction component as the correction parallel unit, wherein the specific generator includes:

a second pulse generator that generates a second pulse signal that is a pulse density modulation signal according to the predetermined value; and a second filter that applies low-pass filter processing to the second pulse signal to thereby generate a first control signal of the predetermined level.

2. The multi-beam light source driving device according to claim 1, the multi-beam light source driving device being for an image forming apparatus including a substantially cylindrical photoconductor drum that rotates about a rotation axis and a deflector that irradiates a surface of the photoconductor drum with a light beam emitted from each of the plurality of light emitting elements and moves an irradiation position of the light beam with respect to the surface of the photoconductor drum in a direction along the rotation axis, wherein a second control signal that is an analog signal different from the plurality of first control signals is input to the driver in addition to the plurality of first control signals, wherein the driver controls the light emitting power of the corresponding light emitting element on a basis of a signal level of each of the plurality of first control signals, and controls the light emitting power of each of the plurality of light emitting elements on a basis of a signal level of the second control signal, wherein the second control signal includes a second correction component for equalizing an irradiation intensity of the light beam to the surface of the photoconductor drum in the direction along the rotation axis, and wherein the predetermined level changes in accordance with the irradiation position of the light beam with respect to the surface of the photoconductor drum in the direction in which the photoconductor drum rotates.

3. The multi-beam light source driving device according to claim 2, further comprising a second generator that generates the second control signal, wherein the second generator includes:

a third pulse generator that generates a third pulse signal that is a pulse density modulation signal according to a second correction value for setting a signal level of the second control signal including the second correction component; and a third filter that applies low-pass filter processing to the third pulse signal to thereby generate the second control signal.

4. The multi-beam light source driving device according to claim 3, further comprising a storage that stores the predetermined value, the first correction value, and the second correction value.

5. An image forming apparatus comprising:

the multi-beam light source driving device according to claim 1;

a substantially cylindrical photoconductor drum that rotates about a rotation axis; and a deflector that irradiates a surface of the photoconductor drum with a light beam emitted from each of the plurality of light emitting elements and moves an irradiation position of the light beam with respect to the surface of the photoconductor drum in a direction along the rotation axis.

6. A multi-beam light source driving device for driving a multi-beam light source including a plurality of light emitting elements, comprising:

a driver that controls a light emitting power of a corresponding light emitting element on a basis of a signal level of each of a plurality of first control signals, the plurality of first control signals being a plurality of analog signals individually corresponding to the plurality of light emitting elements and being input to the driver; and a plurality of first generators that individually generate the plurality of first control signals, wherein some or all of the plurality of first generators are correction parallel units that generate the first control signals including a first correction component for correcting a variation in the light emitting power due to an individual difference of each of the plurality of light emitting elements, the correction parallel units including:

a first multiplier that digitally multiplies a predetermined value for setting the signal level to a predetermined level and a first correction value for exhibiting the first correction component together;

a first pulse generator that generates a first pulse signal that is a pulse density modulation signal according to a multiplication result by the first multiplier; and a first filter that generates the first control signal including the first correction component by applying low-pass filter processing to the first pulse signal, wherein the multi-beam light source driving device being for an image forming apparatus including a substantially cylindrical photoconductor drum that rotates about a rotation axis and a deflector that irradiates a surface of the photoconductor drum with a light beam emitted from each of the plurality of light emitting elements and moves an irradiation position of the light beam with respect to the surface of the photoconductor drum in a direction along the rotation axis, wherein each of the plurality of first control signals includes a second correction component for equalizing an irradiation intensity of the light beam to the surface of the photoconductor drum in the direction along the rotation axis, wherein the predetermined level changes in accordance with the irradiation position of the light beam with respect to the surface of the photoconductor drum in the direction in which the photoconductor drum rotates, and wherein the first multiplier digitally multiplies together a second correction value for exhibiting the second correction component in addition to the predetermined value and the first correction value.

7. The multi-beam light source driving device according to claim 6, wherein a specific generator corresponding to a specific element that is a specific light emitting element among the plurality of first generators generates the first control signal not including the first correction component but including the second correction component, and wherein each of the first generators other than the specific generator among the plurality of first generators generates the first control signal including the first correction component and the second correction component as the correction parallel unit.

8. The multi-beam light source driving device according to claim 7, wherein the specific generator includes:

a second multiplier that digitally multiplies the predetermined value and the second correction value together;

a fourth pulse generator that generates a fourth pulse signal that is a pulse density modulation signal according to a multiplication result by the second multiplier; and a fourth filter that applies low-pass filter processing to the fourth pulse signal to thereby generate the first control signal.

9. The multi-beam light source driving device according to claim 8, wherein the specific generator further includes a first rounding processor that performs rounding processing on a multiplication result by the second multiplier to thereby shorten a data length of the multiplication result by the second multiplier, and wherein the fourth pulse generator generates a pulse density modulation signal according to data after the rounding processing by the first rounding processor as the fourth pulse signal.

10. The multi-beam light source driving device according to claim 6, wherein the correction parallel unit further includes a second rounding processor that performs rounding processing on a multiplication result by the first multiplier to thereby shorten a data length of the multiplication result by the first multiplier, and wherein the first pulse generator generates a pulse density modulation signal according to data after the rounding processing by the second rounding processor as the first pulse signal.

11. A multi-beam light source driving method for driving a multi-beam light source including a plurality of light emitting elements, the multi-beam light source driving method comprising:

generating individually a plurality of first control signals that are analog signals individually corresponding to the plurality of light emitting elements; and when the plurality of first control signals are input, inputting the plurality of first control signals to a driver that controls a light emitting power of a corresponding light emitting element on a basis of a signal level of each of the plurality of first control signals, wherein some of the plurality of first control signals include a first correction component for correcting a variation in the light emitting power due to an individual difference of each of the plurality of light emitting elements, and wherein in order to generate the first control signals including the first correction component, the generating including:

multiplying digitally a predetermined value for setting the signal level to a predetermined level and a first correction value for exhibiting the first correction component together;

generating a first pulse signal that is a pulse density modulation signal according to a multiplication result by the multiplying; and filtering that applies low-pass filter processing to the first pulse signal to thereby generate the first control signal including the first correction component, wherein in the generating, the first control signal of the predetermined level is generated as the first control signal corresponding to a specific element that is a specific light emitting element, and in the generating, the first control signal including the first correction component is generated as the first control signal corresponding to each of the light emitting elements other than the specific element, wherein the generating, in order to generate the first control signal of the predetermined level, includes:

generating a second pulse signal that is a pulse density modulation signal according to the predetermined value; and filtering that applies low-pass filter processing to the second pulse signal to thereby generate a first control signal of the predetermined level.

* * * * *